US012502019B2

(12) United States Patent
Zhu et al.

(10) Patent No.: US 12,502,019 B2
(45) Date of Patent: Dec. 23, 2025

(54) TELESCOPIC CURTAIN GUIDE RAIL

(71) Applicants: Guangdong RAEX Intelligent Technology Co., Ltd, Guangzhou (CN); GUANGDONG WINTOM SUN-SHADE TECHNOLOGY CO., LTD, Guangzhou (CN)

(72) Inventors: Fenjiang Zhu, Guangzhou (CN); Jinbin Tan, Guangzhou (CN); Yusheng Li, Guangzhou (CN)

(73) Assignees: Guangdong RAEX Intelligent Technology Co., Ltd, Foshan (CN); GUANGDONG WINTOM SUN-SHADE TECHNOLOGY CO., LTD, Guangzhou (CN)

( * ) Notice: Subject to any disclaimer, the term of this patent is extended or adjusted under 35 U.S.C. 154(b) by 820 days.

(21) Appl. No.: 17/577,814

(22) Filed: Jan. 18, 2022

(65) Prior Publication Data

US 2022/0233011 A1 Jul. 28, 2022

(30) Foreign Application Priority Data

Jan. 22, 2021 (CN) ..... 202110091169.2
Jul. 21, 2021 (CN) ..... 202110827364.7
(Continued)

(51) Int. Cl.
*A47H 1/08* (2006.01)
*A47H 1/122* (2006.01)
*A47H 5/032* (2006.01)

(52) U.S. Cl.
CPC ..... *A47H 1/08* (2013.01); *A47H 1/122* (2013.01); *A47H 5/0325* (2013.01)

(58) Field of Classification Search
CPC ..... A47H 1/08; A47H 1/122; A47H 5/0325; A47H 1/04; A47H 1/124; A47H 1/144;
(Continued)

(56) References Cited

U.S. PATENT DOCUMENTS 3,891,091 A * 6/1975 Anderson ..... A47H 1/144 211/105.3
10,517,418 B2 * 12/2019 Wu ..... A47H 1/124
2013/0037504 A1 * 2/2013 Graves ..... A47H 5/0325 211/124

FOREIGN PATENT DOCUMENTS

CN 103876599 A * 6/2014 ..... A47H 1/08
CN 108903569 A * 11/2018 ..... A47H 1/08
(Continued)

OTHER PUBLICATIONS

Machine translation CN103876599 (Year: 2014).*
(Continued)

*Primary Examiner* — Abe Massad
*Assistant Examiner* — Jeremy C Ramsey

(57) ABSTRACT

A telescopic curtain guide rail includes an inner rail, an outer rail and a transmission unit. The inner rail is embedded in the outer rail, the transmission unit includes a driving wheel connected with a motor, a driven wheel, two fixed pulleys and a conveyor belt. The driving wheel and the driven wheel are located at two ends of the curtain guide rail, the two fixed pulleys are respectively located at other ends of the inner rail and outer rail. The driving wheel and one fixed pulley are located at two ends of the inner rail or outer rail, the conveyor belt is wound on the driving wheel, the driven wheel and the two fixed pulleys. A telescopic operation of the curtain guide rail can change positions of the two fixed pulleys simultaneously, and the curtain guide rail is simple to use and has a small occupied area.

17 Claims, 22 Drawing Sheets

(30) Foreign Application Priority Data

| | | |
|---|---|---|
| Jul. 21, 2021 | (CN) | 202121664183.9 |
| Jul. 21, 2021 | (CN) | 202121672459.8 |
| Nov. 23, 2021 | (CN) | 202122884642.0 |

(58) Field of Classification Search
CPC .. A47H 2/02; E06B 9/323; E06B 9/26; E06B 9/36; E06B 9/361; E06B 9/364; E06B 9/365; E06B 9/367; E06B 9/368
See application file for complete search history.

(56) References Cited

FOREIGN PATENT DOCUMENTS

| | | | | | |
|---|---|---|---|---|---|
| CN | 110786711 | A | * | 2/2020 | |
| CN | 210643635 | U | * | 6/2020 | |
| CN | 211299426 | U | * | 8/2020 | |
| CN | 112641312 | A | * | 4/2021 | A47H 1/08 |
| CN | 112890563 | A | * | 6/2021 | A47H 1/08 |
| CN | 213849953 | U | * | 8/2021 | |
| DE | 202021103052 | U1 | * | 7/2021 | |

OTHER PUBLICATIONS

Machine translation 108903569 (Year: 2018).*
Machine translation CN 210643635 (Year: 2020).*
Machine translation CN 211299426 (Year: 2020).*
Machine translation CN 112890563 (Year: 2021).*
Machine translation DE 202021103052 (Year: 2021).*
Machine translation CN 213849953 (Year: 2021).*
Machine translation Cn 112641312A (Year: 2021).*
Machine translation CN110786711 (Year: 2020).*

* cited by examiner

TELESCOPIC CURTAIN GUIDE RAIL

TECHNICAL FIELD

The disclosure relates to the technical field of curtain telescopic rods, and more particularly to a telescopic curtain guide rail.

BACKGROUND

Curtain is a household product installed at the window to play a role of shading. At present, various rooms have window walls with different widths. Therefore, the width of the window wall needs to be measured before the curtain guide rail is made, and then the corresponding curtain guide rail is made according to the measured width. This kind of curtain guide rail needs to be customized one by one, which cannot realize mass industrial production; it also needs on-site measurement, which wastes manpower and material resources; if there are errors in the measurement or manufacturing process, the curtain guide rail may not be used and needs to be reworked. Therefore, the traditional curtain guide rail adopts customization method, which has low efficiency, high cost and weak applicability.

Based on the above problems, more and more people begin to study the telescopic curtain guide rail, that is, the length of the curtain guide rail can be telescopically adjusted, and then one specification of the telescopic curtain guide rail can be applied to multiple sizes of windows. Since the telescopic curtain guide rail is still in its infancy, it needs to be wound with the help of multiple pulleys during the stretching and retracting of the curtain guide rail. The existing winding method leads to the increase of the volume of the curtain guide rail and the limited application occasions, which is not conducive to industrialized mass production.

SUMMARY

In view of the shortcomings of the related art, an objective of the disclosure is to provide a telescopic curtain guide rail.

In order to achieve the above objective, the disclosure adopts the following technical scheme: a telescopic curtain guide rail includes: an inner rail, an outer rail, a guide sleeve and a transmission unit, the inner rail is connected to a side of the outer rail, the inner rail is embedded in the outer rail and slidable along the outer rail, the transmission unit includes a driving wheel, a driven wheel, a first fixed pulley, a second fixed pulley and a conveyor belt (also referred to as belt);

the driving wheel and the driven wheel are respectively located at two opposite ends of the telescopic curtain guide rail, and the driving wheel is connected with a motor; the first fixed pulley is located at one of an inner end (also referred to as connecting end) of the inner rail and an inner end (also referred to as connecting end) of the outer rail, and the second fixed pulley is located at the other one of the inner end of the inner rail and the inner end of the outer rail, the driving wheel and the first fixed pulley are respectively disposed on two ends of the inner rail one of which is the inner end of the inner rail, or respectively disposed on two ends of the outer rail one of which is the inner end of the outer rail, the first fixed pulley and the second fixed pulley are located on same sides of the inner rail and the outer rail; the conveyor belt is wound on the driving wheel, the driven wheel, the second fixed pulley and the first fixed pulley sequentially in that order;

when the inner rail moves towards the outer rail, a distance between the driven wheel and the driving wheel is decreased while a distance between the first fixed pulley and the second fixed pulley is increased, or when the inner rail moves away from the outer rail, the distance between the driven wheel while the driving wheel is increased and the distance between the first fixed pulley and the second fixed pulley is decreased.

In an embodiment, the outer rail includes an upper-end first closed groove and a lower-end first opening groove, the inner rail includes an upper-end second closed groove and a lower-end second opening groove, the upper-end first closed groove is embedded in the upper-end second closed groove, the lower-end second opening groove is embedded in the lower-end first opening groove.

In an embodiment, a horizontal cross-sectional area of the lower-end second opening groove is less than that of the lower-end first opening groove, one side wall of the lower-end second opening groove is in contact with one side wall of the lower-end first opening groove, another side wall of the lower-end second opening groove and another side wall of the lower-end first opening groove together form a fixed pulley receiving chamber, a bottom of the fixed pulley receiving chamber includes a bottom surface of the outer rail and a bottom surface of the inner rail, and the bottom surface of the inner rail is located at an upper end of the bottom surface of the outer rail and coincides with the bottom surface of the outer rail;

the driving wheel is fixed at the end of the outer rail facing away from the inner rail, the driving wheel is connected to the motor, the first fixed pulley is fixed at the end of the outer rail close to the inner rail; the driven wheel is fixed at the end of the inner rail facing away from the outer rail, and the second fixed pulley is fixed at the end of the inner rail close to the outer rail.

In an embodiment, the inner rail further includes a first partition plate, the first partition plate is located in the lower-end second opening groove, and an upper end of the first partition plate is fixedly connected to an outer side of a bottom of the upper-end second closed groove, segments of the conveyor belt located on two sides of the driven wheel are respectively disposed on both sides of the first partition plate.

In an embodiment, the first fixed pulley is fixed at the outer rail through a first fixed part (first fixing member), the first fixed part covers outsides of the inner rail and the outer rail, the first fixed part covering the outside of the inner rail extends into the fixed pulley receiving chamber to fix a central axis of the first fixed pulley, and the first fixed part covering the outside of the outer rail is fixed at the outside of the outer rail through fixed screws.

In an embodiment, a central axis of the second fixed pulley is fixed on a side wall of the lower-end second opening groove close to the fixed pulley receiving chamber through a second fixed part (second fixing member), and the central axis of the second fixed pulley and the side wall of the lower-end second opening groove close to the fixed pulley receiving chamber are located in a same plane; and portions of the conveyor belt located on two sides of the second fixed pulley are respectively disposed on two sides of the side wall of the lower-end second opening groove close to the fixed pulley receiving chamber.

In an embodiment, the outer rail includes an L-shaped partition plate, the L-shaped partition plate is located in the fixed pulley receiving chamber and fixedly connected to an inner wall of the lower-end first opening groove, and portions of the conveyor belt located on two sides of the first fixed pulley are respectively located on two sides of the L-shaped partition plate.

In an embodiment, an opening of each of the lower-end first opening groove and the lower-end second opening groove includes right-angle bends, the right-angle bends of the lower-end first opening groove are matched with the right-angle bends of the lower-end second opening groove, and upper surfaces of the right-angle bends of the lower-end first opening groove and upper surfaces of the right-angle bends of the lower-end second opening groove are located at a same horizontal plane.

In an embodiment, the conveyor belt is connected with a conveyor belt buckle, a lower end of the conveyor belt buckle is connected with a rail trolley of curtain (also referred to as curtain slider), and the rail trolley of curtain is connected with a curtain cloth.

In an embodiment, groove bottoms of the upper-end first closed groove and the upper-end second closed groove are disposed with protrusions matched each other.

In an embodiment, the inner rail further includes a first partition plate, the first partition plate is located in the lower-end second opening groove, an upper end of the first partition plate is fixedly connected to an outer side of a bottom of the upper-end second closed groove, segments of the conveyor belt located on two sides of the driven wheel are respectively disposed on two sides of the first partition plate, and groove bottoms of the upper-end first closed groove and the upper-end second closed groove are disposed with protrusions matched each other;

one side wall of the lower-end second opening groove is in contact with one side wall of the lower-end first opening groove, another side wall of the lower-end second opening groove and another side wall of the lower-end first opening groove form a fixed pulley receiving chamber, a bottom of the fixed pulley receiving chamber includes a bottom surface of the outer rail and a bottom surface of the inner rail, and the bottom surface of the inner rail is located at an upper end of the bottom surface of the outer rail and coincides with the bottom surface of the outer rail;

the transmission unit further includes the first fixed pulley and the second fixed pulley; the driving wheel is connected with the motor; the first fixed pulley is located at one of an inner end of the inner rail and an inner end of the outer rail, and the second fixed pulley is located at the other one of the inner end of the inner rail and the inner end of the outer rail, the driving wheel and the first fixed pulley are respectively located at two ends of the inner rail including the inner end of the inner rail or respectively located two ends of the outer rail including the inner end of the outer rail, and the conveyor belt is wound on the driving wheel, the driven wheel, the second fixed pulley and the first fixed pulley;

the first fixed pulley is fixed at the outer rail through a first fixed part, the first fixed part covers outsides of the inner rail and the outer rail, the first fixed part covering the outside of the inner rail extends into the fixed pulley receiving chamber to fix a central axis of the first fixed pulley, and the first fixed part covering the outside of the outer rail is fixed at the outside of the outer rail through fixed screws.

In an embodiment, a central axis of the second fixed pulley is fixed on a side wall of the lower-end second opening groove close to the fixed pulley receiving chamber through a second fixed part, and the central axis of the second fixed pulley and the side wall of the lower-end second opening groove close to the fixed pulley receiving chamber are located in a same plane; and portions of the conveyor belt located on two sides of the second fixed pulley are respectively disposed on two sides of the side wall of the lower-end second opening groove close to the fixed pulley receiving chamber; and the outer rail includes an L-shaped partition plate, the L-shaped partition plate is located in the fixed pulley receiving chamber and fixedly connected with an inner wall of the lower-end first opening groove, and portions of the conveyor belt located on two sides of the first fixed pulley are respectively located on two sides of the L-shaped partition plate.

In an embodiment, a rail trolley of curtain is fixed at a lower end of the conveyor belt, the rail trolley of curtain extends out from the outer rail and the inner rail, the rail trolley of curtain is movable along an axial direction of the outer rail and the inner rail driven by the conveyor belt, and the rail trolley of curtain includes a trolley body and a plurality of pulleys.

In an embodiment, the plurality of pulleys include a plurality of first pulleys and a plurality of second pulleys, the plurality of first pulleys and the plurality of second pulleys are rotatably connected to the trolley body, the trolley body includes an upper main body and a lower main body connected to the upper main body, both sides of the upper main body are provided with the plurality of first pulleys and the plurality of second pulleys, bottoms of the plurality of first pulleys form a first sliding surface, bottoms of the plurality of second pulleys form a second sliding surface, and the second sliding surface is higher than the first sliding surface.

In an embodiment, the inner rail is provided with a first sliding support surface, the outer rail is provided with a second sliding support surface, one of the first pulley and the second pulley is supported on the first sliding support surface when the rail trolley of curtain slides in the inner rail, or the other one of the first pulley and the second pulley is supported on the second sliding support surface when the rail trolley of curtain slides in the outer rail; and a height difference between the second sliding surface and the first sliding surface is matched with a height difference between the first sliding support surface and the second sliding support surface;

each of the plurality of first pulleys is arranged coaxially with corresponding one of the plurality of second pulleys, and a radius of the first pulley is greater than that of the corresponding second pulley; or, each of the plurality of first pulleys and corresponding one of the plurality of second pulleys have different rotation axes, the rotation axes of the first pulley and the corresponding second pulley are parallel and have a same height, and a radius of the first pulley is greater than that of the corresponding second pulley.

In an embodiment, each of the plurality of first pulleys is arranged coaxially with corresponding one of the plurality of second pulleys, or each of the plurality of first pulleys and corresponding one of the plurality of second pulleys have different rotation axes, the first pulley and the corresponding second pulley are arranged in a staggered manner in an axial direction of the first pulley and the second pulley, correspondingly, the first sliding support surface and the second sliding support surface are arranged in a staggered manner in the axial direction of the first pulley and the second pulley;

each of the plurality of first pulleys is arranged coaxially with the corresponding one of the plurality of second pulleys, the first pulley is close to the trolley body, the corresponding second pulley is located on a side of the first pulley facing away from the trolley body, and the first pulley is integrally formed with the corresponding second pulley.

In an embodiment, the rail trolley of curtain further includes a plurality of first guide wheels, the plurality of first guide wheels are rotatably connected to the upper main body, the plurality of first guide wheels transversely penetrates through the upper main body, wheel edges of the plurality of first guide wheels protrude outward relative to sides of the upper main body in a transverse direction, the plurality of first guide wheels are rotatable in the transverse direction, and the plurality of first guide wheels are higher than the second sliding surface;

the rail trolley of curtain further includes a plurality of second guide wheels, the plurality of second guide wheels are installed on a top of the upper main body and rotatable in the transverse direction, wheel edges of the plurality of second guide wheels protrude outward relative to the sides of the upper main body in the transverse direction, the plurality of second guide wheels are higher than the plurality of first guide wheels, and a radius of each of the plurality of second guide wheels is different from that of each of the plurality of first guide wheels;

the inner rail is provided with a first guide groove therein, the outer rail is provided with a second guide groove therein; when the rail trolley of curtain slides in the inner rail, one of the first guide wheel and the second guide wheel is located in the first guide groove and matched with the first guide groove, or when the rail trolley of curtain slides in the outer rail, the other one of the first guide wheel and the second guide wheel is located in the second guide groove and matched with the second guide groove; widths of the first guide groove and the second guide groove are different, and a width difference between the first guide groove and the second guide groove is matched with a diameter difference between the first guide wheel and the second guide wheel.

In an embodiment, the plurality of first pulleys have a same size and are symmetrically arranged on two sides of the trolley body, and the plurality of second pulleys have a same size and are symmetrically arranged on the two sides of the trolley body; the rail trolley of curtain further includes a plurality of outer pulleys arranged on the two sides of the trolley body in pairs, and the plurality of outer pulleys are located below the first sliding surface and is spaced a predetermined height from the first sliding surface.

In an embodiment, the trolley body is provided with threading through holes, and the conveyor belt includes a first conveyor belt and a second conveyor belt, the first conveyor belt is connected to the second conveyor belt and sleeved on the driving wheel and the driven wheel to make the driving wheel in transmission connection with the driven wheel, the second conveyor belt is engaged with the driving wheel or the driven wheel, and the first conveyor belt is a rope, the first conveyor belt passes through the threading through holes to make the rail trolley of curtain be connected to the first conveyor belt and move on the outer rail and/or the inner rail driven by the first conveyor belt.

In an embodiment, the trolley body includes an upper main body and a lower main body connected with the upper main body, the plurality of pulleys are rotatably installed on the upper main body; and the threading through holes include first threading through holes and second threading through holes, the upper main body is provided with the first threading through holes, the lower main body is provided with the second threading through holes, the first conveyor belt sequentially passes through the first threading through holes and the second threading through holes to fix the rail trolley of curtain, the upper main body of the rail trolley of curtain is slidable in the outer rail and/or the inner rail, the lower main body of the rail trolley of curtain is located outside the outer rail and the inner rail, and portions of the first conveyor belt are distributed on two sides of the trolley body of the rail trolley of curtain.

In an embodiment, the first conveyor belt includes a first rope section and a second rope section, the first rope section and the second rope section are separated from each other, and a first end of the first rope section is connected with a first end of the second conveyor belt, a second end of the first rope section passes through one of the first threading through holes and one of the second threading through holes and is fixed on the rail trolley of curtain, a first end of the second rope section is connected with a second end of the second conveyor belt, and a second end of the second rope section passes through the other one of the first threading through holes and the other one of the second threading through holes and is fixed on the rail trolley of curtain.

In an embodiment, the rail trolley of curtain further includes a threading fixed device, the threading fixed device is disposed on a side of the lower main body close to the second threading through holes or disposed in the second threading through holes, and the threading fixed device fixes the second end of the first rope section and the second end of the second rope section onto the rail trolley of curtain.

In an embodiment, each of the second threading through holes is a threading bolt hole arranged on the lower main body in a vertical direction, each of the second threading through holes includes a second through hole upper opening and a second through hole lower opening, the second through hole lower opening is disposed on a bottom of the lower main body; the threading fixed device includes threading bolts and threading nuts, the threading bolts are matched with the second threading through holes respectively, the threading nuts are matched with the second through hole upper openings of the second threading through holes; the second end of the first rope section and the second end of the second rope section are fixed on the rail trolley of curtain by cooperation of the threading bolts and threading nuts.

In an embodiment, the trolley body of the rail trolley of curtain is further provided with third threading through holes, the third threading through holes transversely penetrate through the trolley body of the rail trolley of curtain, and the first conveyor belt passes through the first threading through holes, the third threading through holes and the second threading through holes sequentially in that order.

In an embodiment, each of the first threading through holes includes a first end opening and a second end opening connected with the first end opening, the first end opening is disposed on one side of the upper main body, and the second end opening is disposed on the other side of the upper main body; the first end opening disposed on the one side surface of the upper main body is higher than ones of the plurality of pulleys disposed on the one side of the upper main body and outward protruding parts of the ones of the plurality of pulleys disposed on the one side of the upper main body, and the second end opening disposed on the other side of the upper main body is lower than the others of the plurality of pulleys disposed on the other side of the upper main body and outward protruding parts of the others of the plurality of pulleys disposed on the other side of the upper main body.

In an embodiment, each of the first threading through holes is an arc through hole transversely penetrating through the trolley body, and the first end opening and the second end opening are disposed on the two sides of the trolley body in a staggered manner.

In an embodiment, a connecting end (inner end) of the outer rail is inserted into the guide sleeve from a second end of the guide sleeve and matched with the guide sleeve, a free end (outer end) of the outer rail extends out from the guide sleeve, the inner rail is inserted into the guide sleeve from a first end of the guide sleeve and matched with the guide sleeve, a connecting end (inner end) of the inner rail is inserted into the outer rail, a free end (outer end) of the inner rail extends out from the guide sleeve, and a rail trolley of curtain is fixed at a lower end of the conveyor belt, and the rail trolley of curtain can pass through the guide sleeve when moves between the outer rail and the inner rail.

In an embodiment, a bottom surface of the guide sleeve is provided with a first support surface and a second support surface, the first support surface extends inward along an axial direction of the guide sleeve from the first end of the guide sleeve, the second support surface extends inward along the axial direction of the guide sleeve from the second end of the guide sleeve, the first support surface is connected with the second support surface, the first support surface is higher than the second support surface, and a step is formed at a connection between the first support surface and the second support surface, the first support surface supports the inner rail, the second support surface supports the outer rail, the outer rail abuts against the step, a height difference of bottom surfaces of the outer rail and the inner rail is matched to a height difference between the second support surface and the first support surface.

In an embodiment, the bottom surface of the guide sleeve is provided with a through groove penetrating the first support surface and the second support surface, a bottom of the inner rail is provided with a first sliding opening along the axial direction, a bottom of the outer rail is provided with a second sliding opening along the axial direction, the first sliding opening is communicated with the second sliding opening, and both ends of the through groove are respectively communicated with the first sliding opening and the second sliding opening;

the through groove includes a first through section and a second through section, the first through section is communicated/connected with the second through section, positions of the first through section and the second through section correspond to positions of the first support surface and the second support surface respectively, a width of the first through section close to the first end of the guide sleeve is greater than a width of the first sliding opening, a width of the first through section close to the second through section is matched with the width of the first sliding opening, and a width of the second through section is matched with a width of the second sliding opening;

the guide sleeve further includes transition tables, the transition tables are disposed on the both sides of the through groove and protrude upward relative to the first support surface, the transition tables are extended outward along the axial direction of the guide sleeve from the connection between the first support surface and the second support surface, an inner surface of the bottom of the outer rail is provided with a second sliding support surface, the second sliding support surface is axially extended from the connecting end of the outer rail towards the other end of the outer rail, the second sliding support surface is higher than the inner surface of the bottom of the outer rail; when the outer rail is matched with the guide sleeve, the transition tables are butted and matched with the second sliding support surface in the axial direction of the guide sleeve, and the second sliding support surface is higher than the transition tables;

the rail trolley of curtain extends out of the outer rail and the inner rail, the rail trolley of curtain is movable along the axial direction of the outer rail and the inner rail driven by the conveyor belt, the rail trolley of curtain is rotatably installed with a plurality of second pulleys, the plurality of second pulleys are slidable upward from the transition tables to the second sliding support surface or downward from the second sliding support surface to the transition tables.

In an embodiment, an upper part of the guide sleeve is provided with first guide rails and second guide rails, the first guide rails and the second guide rails are respectively disposed on the first support surface and the second support surface and extend along the axial direction of the guide sleeve, the first guide rails are connected to the second guide rails, connections of the first guide rails and the second guide rails are provided with second steps, the first guide rails are matched with a top of the inner rail to fix both sides of the inner rail relative to the guide sleeve, and the second guide rails are matched with a top of the outer rail to fix both sides of the outer rail relative to the guide sleeve.

In an embodiment, a thickness of the bottom surface of the guide sleeve gradually becomes thinner from the connection between the first support surface and the second support surface to the first end of the guide sleeve, an outer surface of the bottom of the guide sleeve is provided with a transition surface, the transition surface is disposed on a back of the first support surface and on the both sides of the through groove, one end of the transition surface close to the connection between the first support surface and the second support surface is matched with the outer rail, the other end of the transition surface is matched with the inner rail, and a height difference between the one end of the transition surface matched with the outer rail and the other end of the transition surface is matched with a height difference between the inner rail and the outer rail;

when the bottom surface of the guide sleeve is placed on a horizontal plane, the transition surface is arranged obliquely relative to the horizontal plane, and a height of the transition surface close to the connection between the first support surface and the second support surface is higher than a height of the transition surface close to the first end of the guide sleeve.

In an embodiment, the guide sleeve further includes a first mating surface and a second mating surface, the first mating surface extends inward along the axial direction of the guide sleeve from both side surfaces and a top surface of the first end of the guide sleeve together with the first support surface form an annular surface with an opening at a bottom thereof, the second mating surface extends inward along the axial direction of the guide sleeve from two side surfaces and a top surface of the second end of the guide sleeve and together with the second support surface form an annular surface with an opening at a bottom thereof; compared with the second mating surface, the first mating surface is closer to a central axis of the guide sleeve; in the axial direction of the guide sleeve, the first mating surface is connected with the second mating surface, and a third step is formed at a connection between the first mating surface and the second mating surface.

In an embodiment, the telescopic curtain guide rail further includes a fixed component, the fixed component passes through an outer housing of the guide sleeve from outside of the guide sleeve and partially extends into the guide sleeve, and the fixed component is connected with the inner rail and/or the outer rail to fix the inner rail and/or the outer rail relative to the guide sleeve; or, the fixed component includes a fixed bolt and a fixed plate, the fixed plate is disposed in the guide sleeve, the guide sleeve and the fixed plate are provided with fixed bolt holes matching with the fixed bolt, and the fixed plate moves inward to press and fix the inner rail, or moves outward to clamp and fix the inner rail between the fixed plate and the guide sleeve under rotating cooperation of the fixed bolt and the fixed bolt holes.

In an embodiment, the telescopic curtain guide rail further includes an adjusting component fixedly connected with the first fixed pulley and/or the second fixed pulley, the adjusting component is configured to cooperate with the first fixed pulley and/or the second fixed pulley to tension or loosen the conveyor belt, the guide sleeve is provided with an adjusting installation groove therein, and the adjusting installation groove is disposed in a space surrounded by the first support surface.

In an embodiment, the adjusting component includes an adjusting nut and an adjusting screw matched with the adjusting nut, and a cooperation of the adjusting screw and the adjusting nut drives the first fixed pulley and/or the second fixed pulley to move; the adjusting component further includes a stopper, upper and lower ends of the adjusting nut extend towards the stopper and are connected with the stopper, an installation area is formed between the stopper and the adjusting nut, the installation area is fixed with the first fixed pulley and/or the second fixed pulley, a side of the stopper close to the adjusting nut is an arc surface, portions of the conveyor belt located on two sides of the first fixed pulley and/or the second fixed pulley in the installation area are respectively located on two sides of the stopper;

one end of the adjusting installation groove is provided with an opening, the other end of the adjusting installation groove is provided with a baffle, the opening is disposed close to the second support surface, the adjusting component is fixed in the adjusting installation groove, the baffle is provided with a through hole, the adjusting screw passes through the through hole to match with the adjusting nut, and the adjusting screw drives the adjusting component to move away from or close to the baffle when being rotated;

a top wall of the adjusting installation groove is provided with a first opening, a bottom wall of the adjusting installation groove is provided with a second opening opposite to the first opening, the first fixed pulley and/or the second fixed pulley are fixed on the adjusting component through a fixed shaft, and two ends of the fixed shaft extend into the first opening and the second opening respectively;

the adjusting installation groove is disposed in the space surrounded by the first support surface, the adjusting component is fixed in the adjusting installation groove and slidably connected with the adjusting installation groove, the first fixed pulley is fixed on the adjusting component, and an end of a first outer rail inner wall abuts against the top wall of the adjusting installation groove, an end of a second outer rail inner wall of the outer rail abuts against the bottom wall of the adjusting installation groove, there is a third insertion gap between the bottom wall of the adjusting installation groove and the first support surface, and a bottom wall of a lower-end second opening groove of the inner rail passes through the third insertion gap and then is inserted into a second insertion gap.

In an embodiment, the outer rail includes an upper-end first closed groove and a lower-end first opening groove, a side wall of the lower-end first opening groove is provided with a first outer rail inner wall and a second outer rail inner wall extending inwardly towards the lower-end first opening groove, there is a first insertion gap between a bottom wall of the upper-end first closed groove and the first outer rail inner wall, there is a second insertion gap between a bottom wall of the lower-end first opening groove and the second outer rail inner wall, the conveyor belt is located between the first outer rail inner wall and the second outer rail inner wall; the inner rail includes an upper-end second closed groove and a lower-end second opening groove, a bottom wall of the upper-end second closed groove is inserted into the first insertion gap, and a bottom wall of the upper-end second opening groove is inserted into the second insertion gap.

In an embodiment, the outer rail includes the lower-end first opening groove, the inner rail includes the lower-end second opening groove, when the inner rail is engaged with the outer rail, a first side wall of the inner rail divides the lower-end first opening groove into a first cavity and a second cavity, the second fixed pulley is fixed on the inner rail through a second fixed component, the second fixed component is provided with a connecting clamp, the connecting clamp clamps an end of the first side wall, and portions of the conveyor belt located on two sides of the second fixed pulley are located in the first cavity and the second cavity respectively.

In an embodiment, the conveyor belt includes a first connecting section and a second connecting section connected each other, the first connecting section and the second connecting section are connected in a head-to-tail manner, the first connecting section is matched with the driving wheel, the second connecting section is wound on the first fixed pulley and the second fixed pulley, and a belt thickness of the first connecting section is greater than a belt thickness of the second connecting section; and the first connecting section is one or more selected from the group consisting of a belt, a steel wire and a rope; and the second connecting section is one or more selected from the group consisting of a belt, a steel wire and a rope.

The beneficial effects of the disclosure are: the unique winding structure adopted by the disclosure ensures that the length of the conveyor belt remains unchanged and the conveyor belt is always in a tensioned state during the opening and closing of the curtain; the curtain guide rail of the disclosure is stretched and retracted to drive the positions of two fixed pulleys to change at the same time, the stretching and retracting operation is simple, the floor area is small, it is conducive to mass industrial production, has a wide range of application, and reduces the transportation cost and production cost.

DESCRIPTION OF REFERENCE NUMERALS

Figure 1:
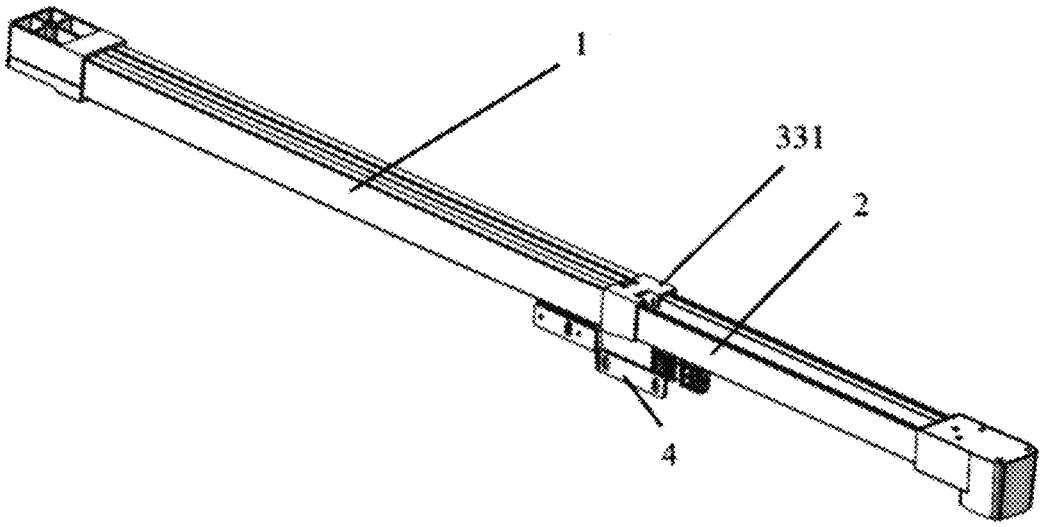
FIG. 1 is a schematic structural diagram of the telescopic guide rail according to an embodiment of the disclosure.

1—outer rail; 11—L-shaped partition plate; 2—inner rail; 21—fixed pulley receiving chamber; 22—first partition plate; 23—bend; 31—driving wheel; 32—driven wheel; 33—first fixed pulley; 331—first fixed part; 34—second fixed pulley; 35—conveyor belt; 4—rail trolley of curtain; 1*a*—upper-end first closed groove; 2*a*—upper-end second closed groove; 1*b*—lower-end first opening groove; 2*b*—lower-end second opening groove; 1*c*—protrusion of the upper-end first closed groove, 2*c*—protrusion of the upper-end second closed groove; 1*d*—side wall of the lower-end first opening groove; 2*d*—side wall of the lower-end second opening groove;

100—curtain guide rail fixed device; 101—guide sleeve; 102—first support surface; 103—second support surface; 104—first guide rail; 105—second guide rail; 106—first mating surface; 107—second mating surface; 108—through groove; 109—first through section; 110—second through section; 111—transition surface; 112—transition table; 113—fixed component; 114—fixed bolt; 115—fixed bolt hole; 116—T-shaped nut; 117—limit part; 201—first sliding opening; 202—first sliding support surface; 203—first guide groove; 204—second guide groove; 301—second sliding opening; 302—second sliding support surface; 401—trolley body; 402—first pulley; 403—second pulley; 404—first guide wheel; 405—second guide wheel; 406—outer pulley; 407—first threading through hole; 408—second threading through hole; 409—third threading through hole; 410—lead table; 411—threading fixed device; 4111—threading bolt; 4112—threading nut; 4071—first end opening; 4072—second end opening; 4081—second through hole upper opening; 4082—second through hole lower opening; 501—steel wire rope; 502—synchronous belt; 503—engaging portion;

1023—step; 12—upper-end first closed groove; 13—lower-end first opening groove; 14—first outer rail inner wall; 15—second outer rail inner wall; 131—first insertion gap; 132—second insertion gap; 1011—adjusting installation groove; 1012—baffle; 1013—through hole; 51—stopper; 1014—first opening; 1015—second opening; 331—fixed shaft; 26—first side wall; 27—connecting clamp; 133—third insertion gap; 311—adjusting nut; 312—adjusting screw; 351—first connecting section; 352—second connecting section.

DETAILED DESCRIPTION OF EMBODIMENTS

In the following, the disclosure will be further described in combination with the accompanying drawings and specific embodiments:

As shown in FIG. 1 to FIG. 32, an embodiment of the disclosure provides a telescopic curtain guide rail including: an inner rail 2, an outer rail 1 and a transmission unit. The inner rail 2 is connected to a side of the outer rail 1, the inner rail 2 is embedded in the outer rail 1 and slidable along the outer rail 1. The transmission unit includes a driving wheel 31, a driven wheel 32, a first fixed pulley 33, a second fixed pulley 34 and a conveyor belt 35. The driving wheel 31 and the driven wheel 32 are respectively located at two opposite ends of the telescopic curtain guide rail, the two opposite ends of the telescopic curtain guide rail are the ends where the inner rail and the outer rail are away from each other, that is, the driving wheel and the driven wheel are located at two ends of the inner rail and the outer rail respectively. Specifically, the driving wheel can be located at one end of the inner rail or one end of the outer rail. The driving wheel 31 is connected to the motor. The first fixed pulley 33 and the second fixed pulley 34 are respectively located at the other ends of the inner rail and the outer rail, in order to distinguish the first fixed pulley from the second fixed pulley, the disclosure defines that the driving wheel and the first fixed pulley are located at two ends of the inner rail or the outer rail at the same time, and the driven wheel and the second fixed pulley are located at two ends of the outer rail or the inner rail at the same time. Of course, the first fixed pulley and the second fixed pulley are only to distinguish in naming, when the driving wheel and the second fixed pulley are located at two ends of the inner rail or the outer rail at the same time, it is only necessary to exchange the following first fixed pulley and the second fixed pulley of the disclosure.

The unique feature of the transmission unit of the disclosure is that the first fixed pulley 33 and the driving wheel 31 are fixed at both ends of the outer rail 1, the second fixed pulley 34 and the driven wheel 32 are fixed at both ends of the inner rail 2, and the winding mode of the conveyor belt 35 is the driving wheel 31—the driven wheel 32—the second fixed pulley 34—the first fixed pulley 33—the driving wheel 31, and the first fixed pulley 33 and the second fixed pulley 34 are located on the same sides of the inner rail 2 and the outer rail 1. This winding mode ensures that when the driving wheel 31 is close to the driven wheel 32, the first fixed pulley 33 is away from the second fixed pulley 34, and ensures that the total length of the conveyor belt 35 remains unchanged. The winding mode is simple, and the floor area is small, which reduces the production cost and transportation cost.

As shown in FIG. 2 to FIG. 6, the outer rail 1 of the embodiment includes an upper-end first closed groove and a lower-end first opening groove, the inner rail 2 includes an upper-end second closed groove and a lower-end second opening groove, the upper-end first closed groove is embedded in the upper-end second closed groove, the lower-end second opening groove is embedded in the lower-end first opening groove. A horizontal cross-sectional area of the lower-end second opening groove is less than that of the lower-end first opening groove, one side wall of the lower-end second opening groove is in contact with one side wall of the lower-end first opening groove, the other side wall of the lower-end second opening groove and the other side wall of the lower-end first opening groove together form a fixed pulley receiving chamber 21. In the above description, the closed groove (the upper-end first closed groove and the upper-end second closed groove) refers to that the groove has the bottom as shown at the upper ends of the inner rail 2 and the outer rail 1 in FIG. 3 and FIG. 4, the opening groove (the upper-end first opening groove and the upper-end second opening groove) refers to that the groove is a cavity structure and the upper end surface of the cavity structure shares a surface with the bottom of the closed groove as shown at the lower ends of the inner rail 2 and the outer rail 1 in FIG. 3 and FIG. 4. It can be clearly seen from the attached drawings that the lower end of the outer rail 1 is an integral opening groove structure, while the lower end of the inner rail 2 includes an opening groove structure and the fixed pulley receiving chamber 21. Only the first fixed pulley is installed in the fixed pulley receiving chamber 21, and the second fixed pulley is just located in the plane on the side shared by the lower-end second opening groove and the fixed pulley receiving chamber 21.

As shown in FIG. 2 to FIG. 6, a bottom of the fixed pulley receiving chamber 21 includes a bottom surface of the outer rail 1 and a bottom surface of the inner rail 2, and the bottom surface of the inner rail 2 is located above the bottom surface of the outer rail 1 and coincides with the bottom surface of the outer rail 1. The outer rail 1 includes an L-shaped partition plate 11, the L-shaped partition plate 11 is located in the fixed pulley receiving chamber and fixedly connected with an inner wall of the lower-end first opening groove, and portions of the conveyor belt located on two sides of the first fixed pulley are respectively located on two sides of the L-shaped partition plate 11. The inner rail 2 further includes a first partition plate 22, the first partition plate 22 is located in the lower-end second opening groove, and an upper end of the first partition plate 22 is fixedly connected to an outside of a bottom of the upper-end second closed groove, segments of the conveyor belt located on both sides of the driven wheel are respectively disposed on both sides of the first partition plate 22.

As shown in FIG. 2 to FIG. 6, an opening of each of the lower-end first opening groove and the lower-end second opening groove includes bends 23, the bends 23 of the lower-end first opening groove are matched with the bends 23 of the lower-end second opening groove, and upper surfaces of the bends of the lower-end first opening groove and upper surfaces of the bends of the lower-end second opening groove are located at a same horizontal plane. the bend 23 can be a right-angle bend or a bend with radian; the bend is set here because the rail trolley of curtain on the belt buckle needs to move between lower-end opening grooves of the inner rail 2 and the outer rail 1, in order to ensure the smooth movement of the rail trolley of curtain, clamping plates are usually set inside and outside the lower-end opening grooves respectively, the bend here can ensure the smooth transition of the rail trolley of curtain from the inner rail 2 to the outer rail 1, and smooth sliding in the overlapping area of the inner rail 2 and the outer rail 1. The groove bottoms of the upper-end first closed groove and the upper-end second closed groove are disposed with protrusions matched each other.

Figure 6:
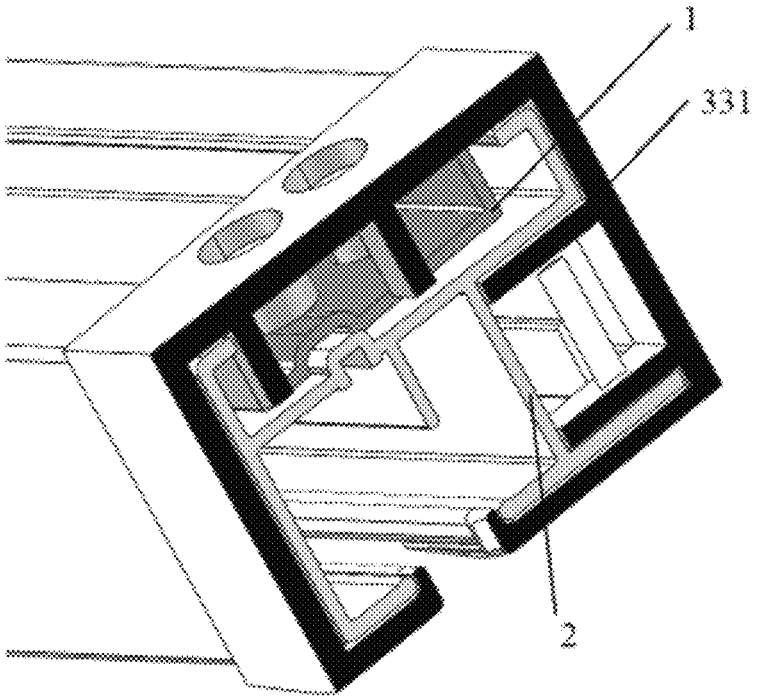
FIG. 6 is a schematic sectional diagram of the outer rail and the inner rail from a second view angle according to an embodiment of the disclosure.
Figure 7:
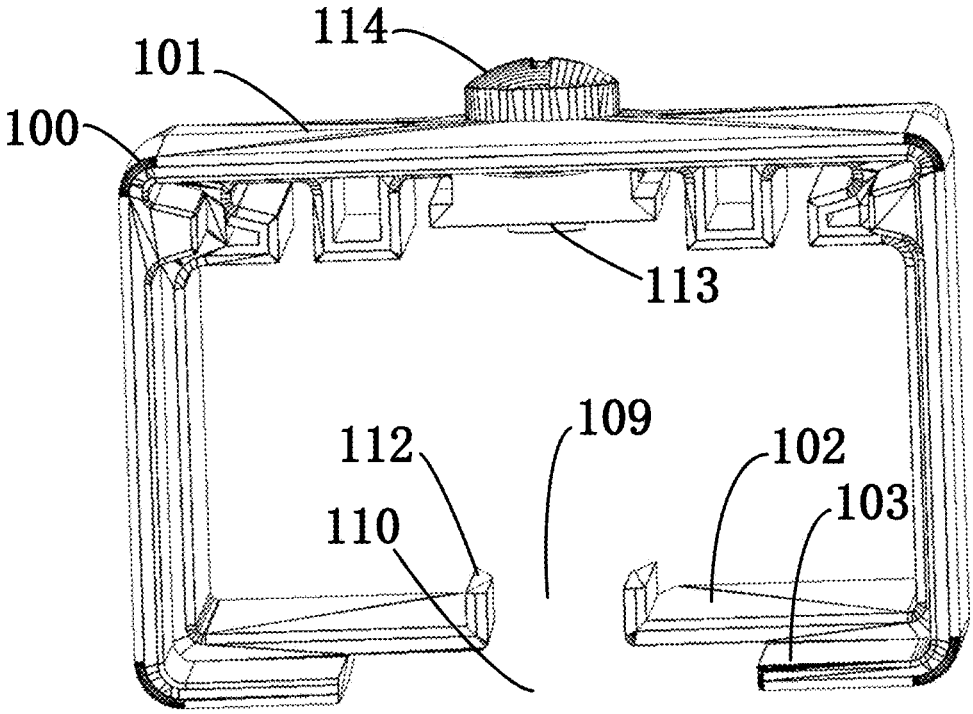
FIG. 7 is a schematic structural diagram of the curtain guide rail fixed device from a front view according to an embodiment of the disclosure.
Figure 8:
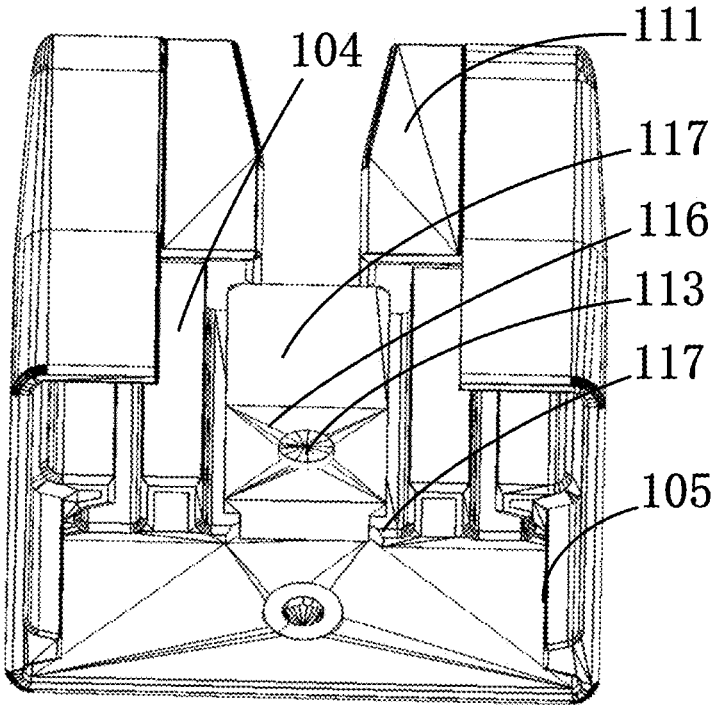
FIG. 8 is a schematic structural diagram of the curtain guide rail fixed device from a bottom view according to an embodiment of the disclosure.
Figure 9:
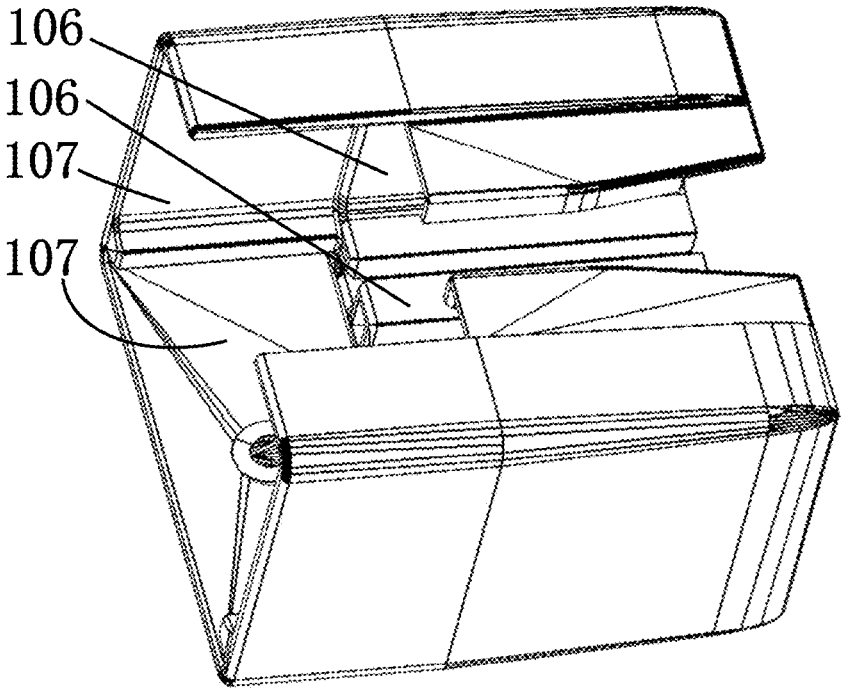
FIG. 9 is a schematic structural diagram of the curtain guide rail fixed device from a bottom view at a certain angle according to an embodiment of the disclosure.
Figure 10:
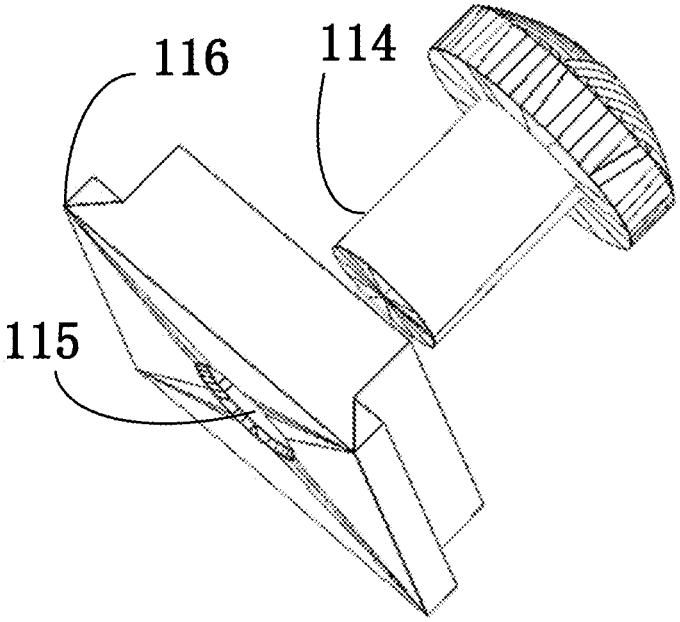
FIG. 10 is a schematic structural diagram of the fixed component according to an embodiment of the disclosure.
Figure 11:
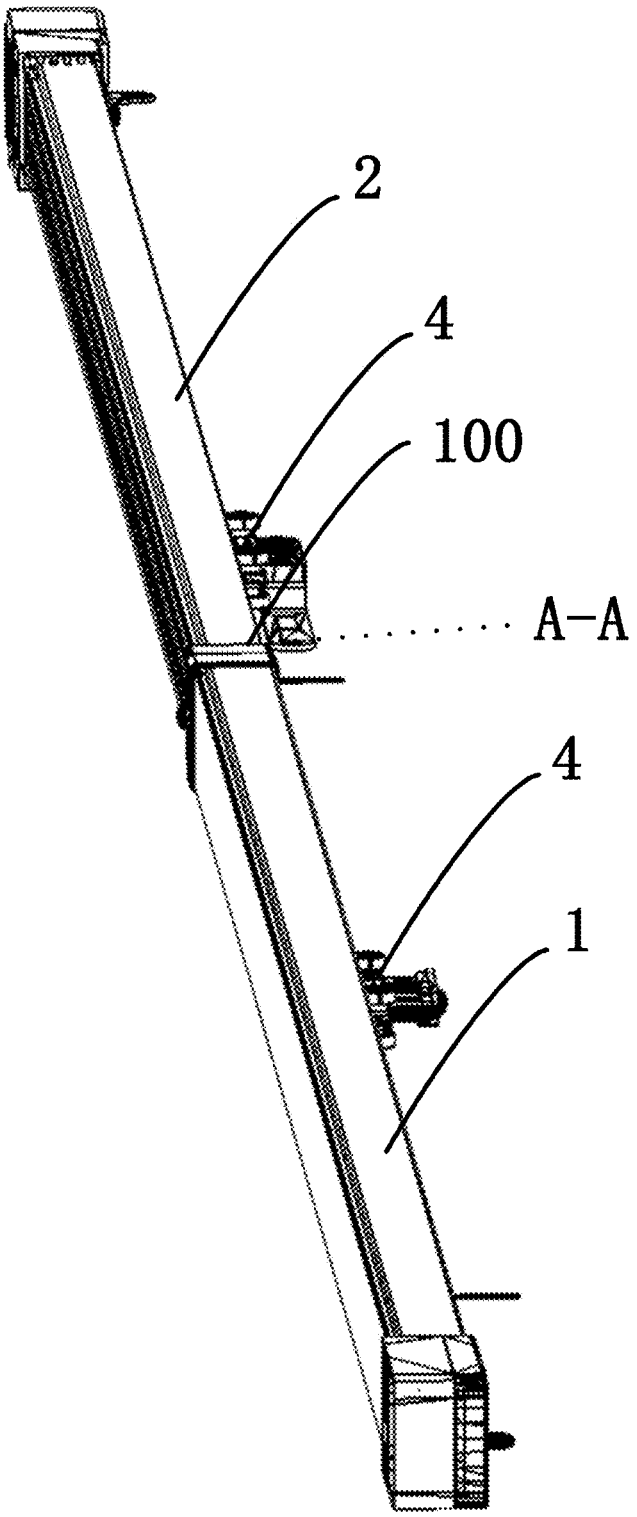
FIG. 11 is a schematic structural diagram of the telescopic guide rail according to an embodiment of the disclosure.
Figure 12:
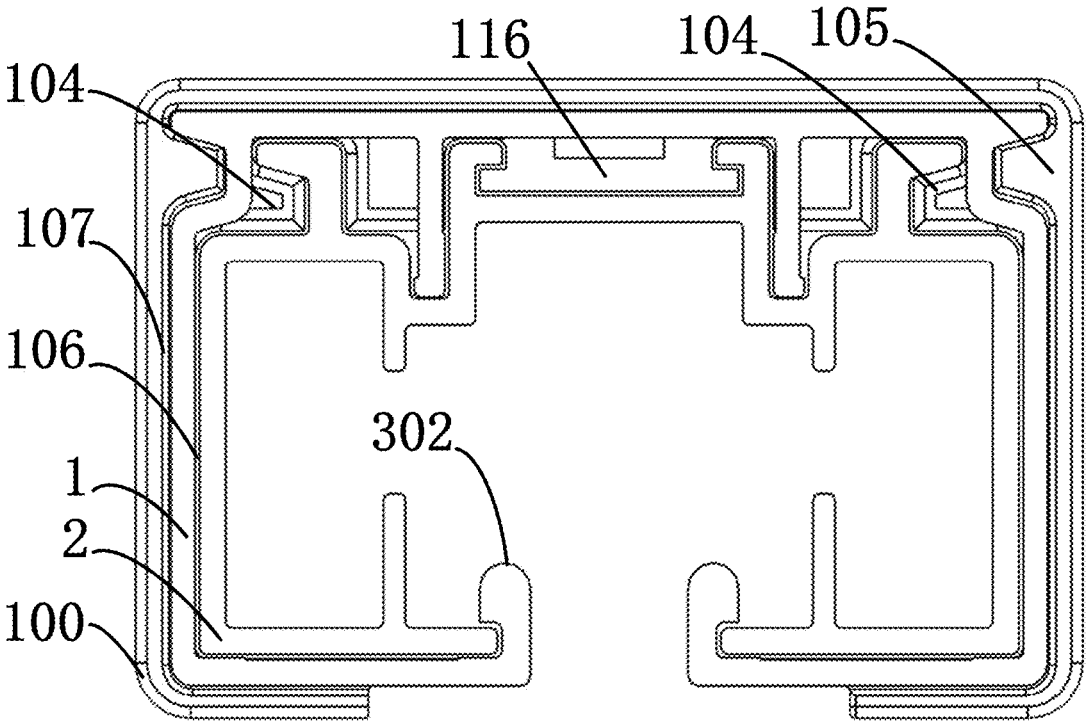
FIG. 12 is a schematic sectional diagram of the portion A-A of the telescopic guide rail in FIG. 11 according to an embodiment of the disclosure.
Figure 13:
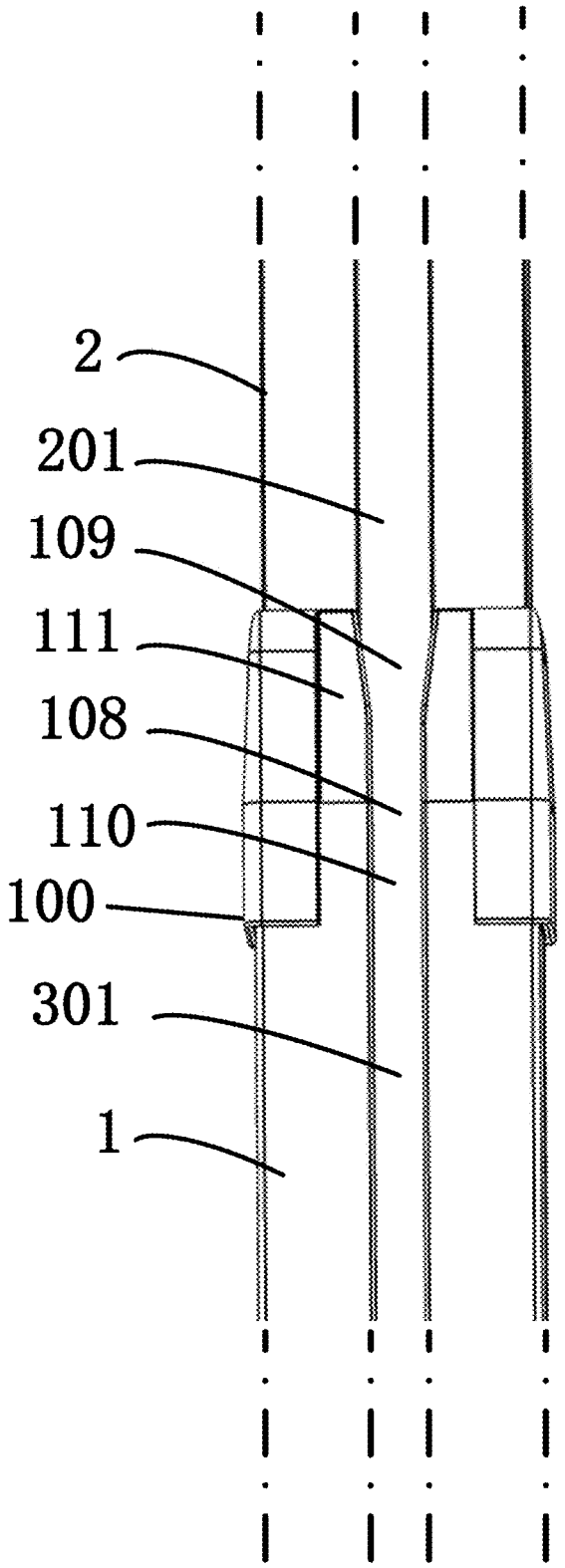
FIG. 13 is a partial schematic structural diagram of the cooperation of the inner rail, the outer rail and the curtain guide rail fixed device according to an embodiment of the disclosure.
Figure 14:
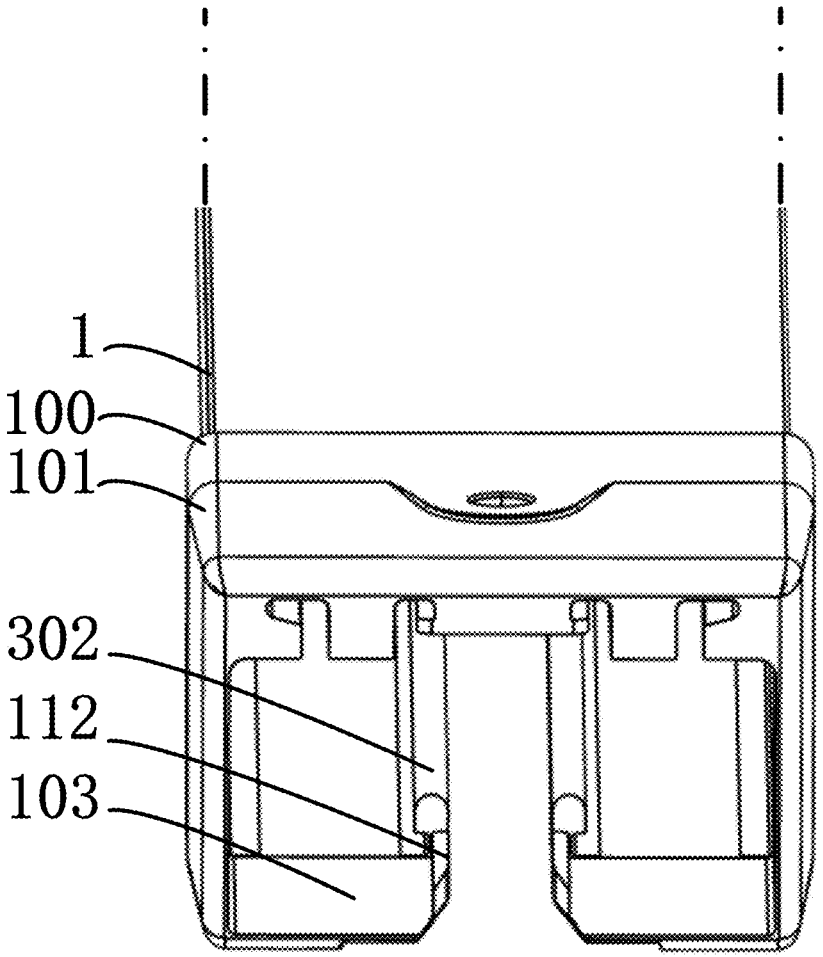
FIG. 14 is a partial schematic structural diagram of the cooperation of the outer rail and the curtain guide rail fixed device according to an embodiment of the disclosure.
Figure 15:
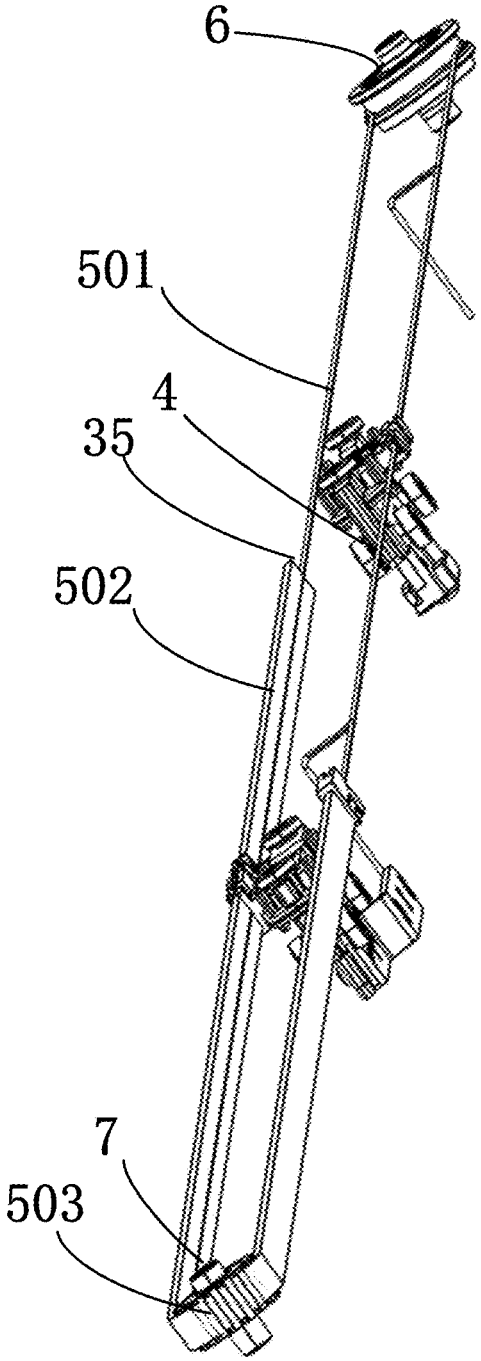
FIG. 15 is an internal schematic structural diagram of the telescopic guide rail according to an embodiment of the disclosure.
Figure 16:
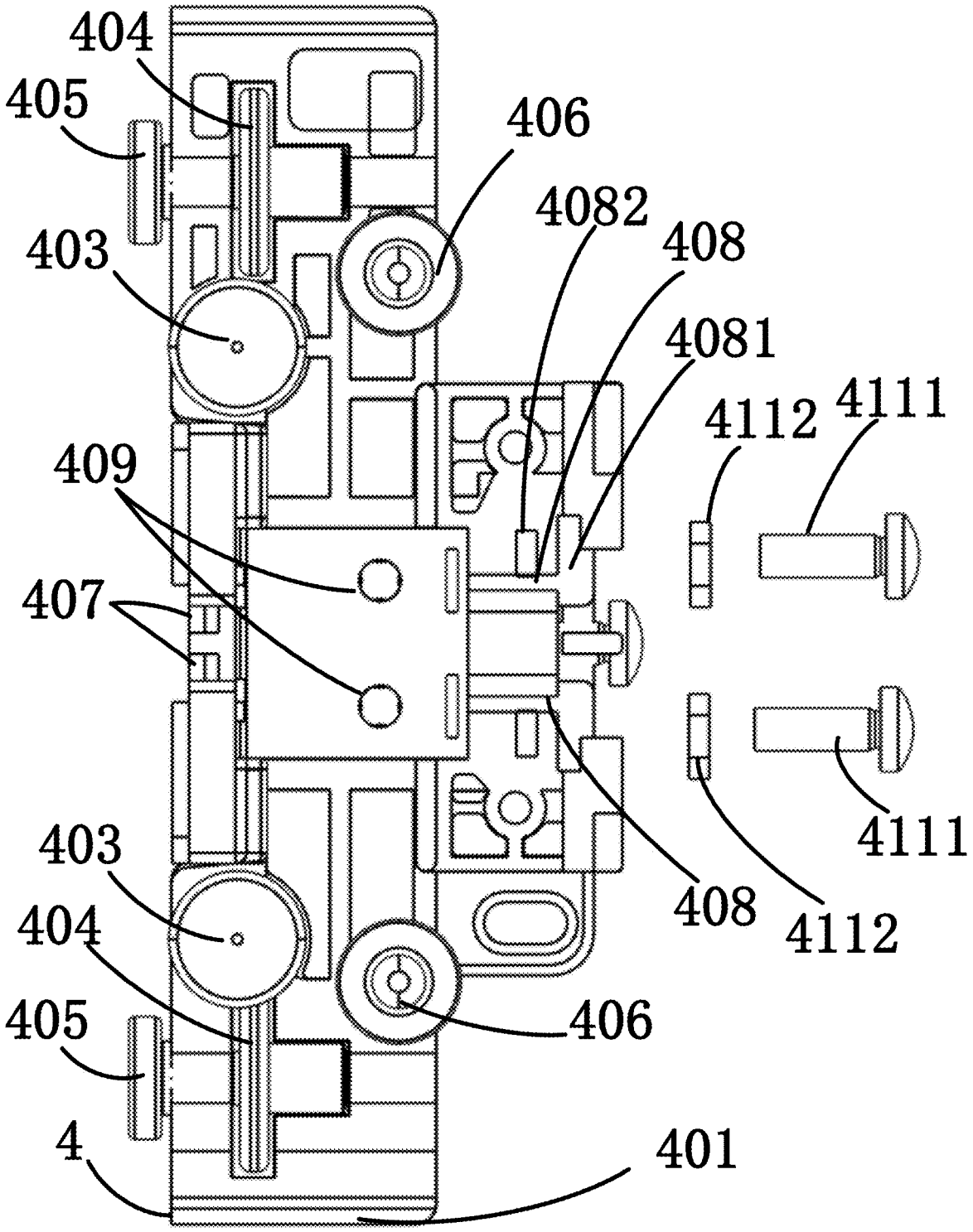
FIG. 16 is a schematic structural diagram of the rail trolley of curtain and the fixed component according to an embodiment of the disclosure.
Figure 17:
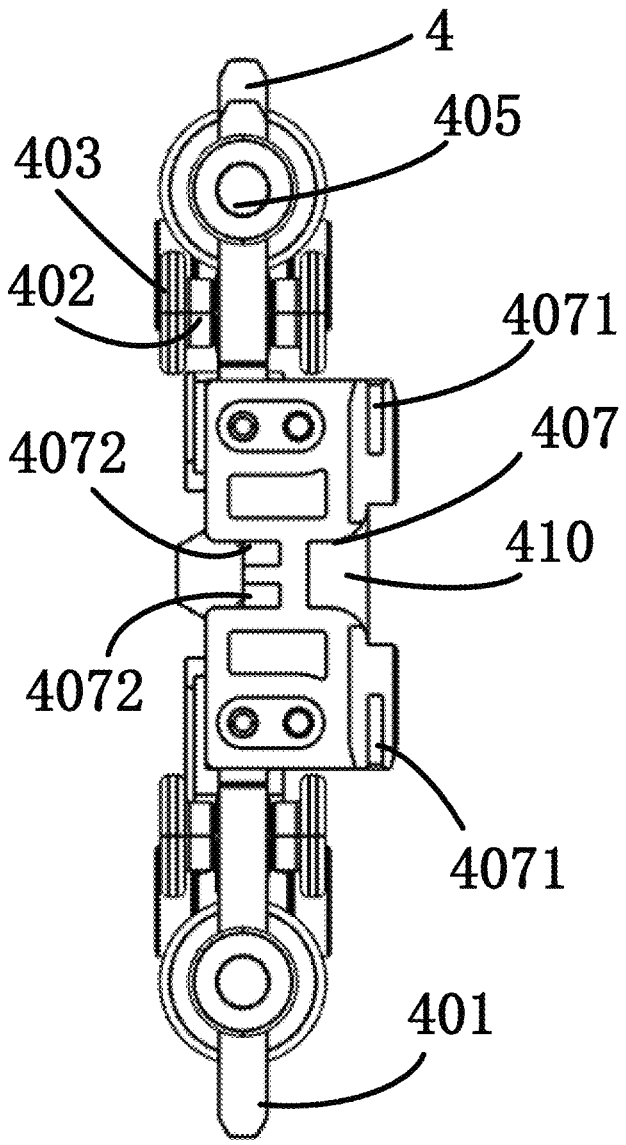
FIG. 17 is a schematic structural diagram of the rail trolley of curtain from a top view according to an embodiment of the disclosure.
Figure 18:
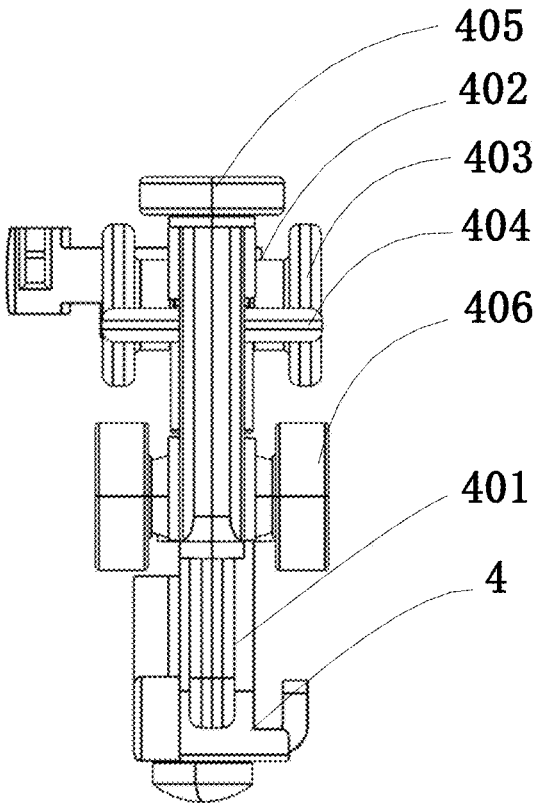
FIG. 18 is a schematic structural diagram of the rail trolley of curtain from a front view according to an embodiment of the disclosure.
Figure 19:
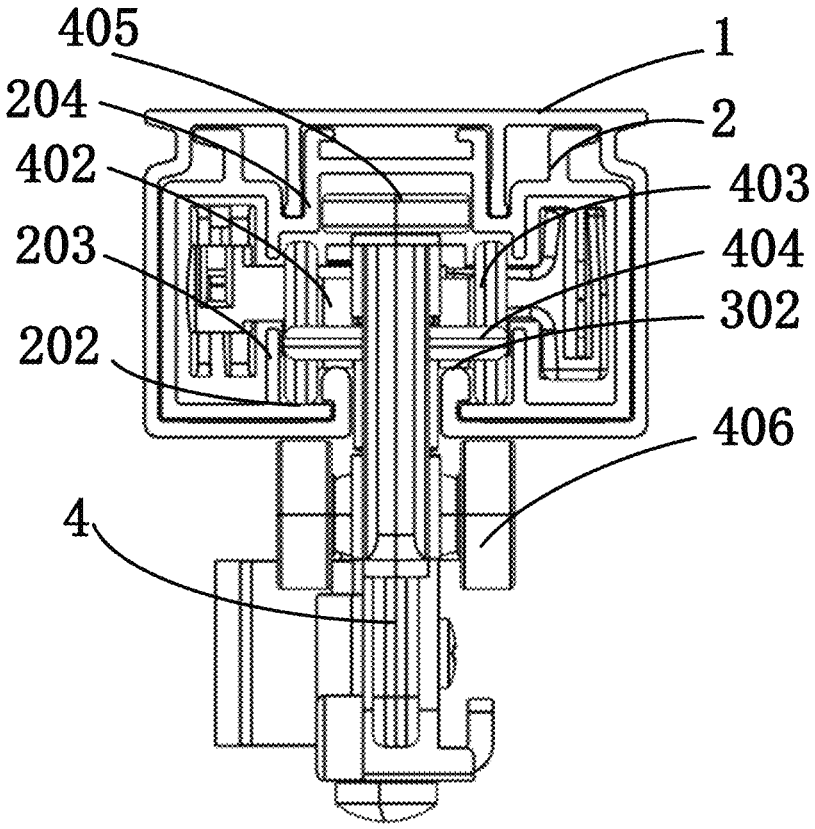
FIG. 19 is a schematic structural diagram of the cooperation of the rail trolley of curtain, the inner rail and the outer rail according to an embodiment of the disclosure.
Figure 20:
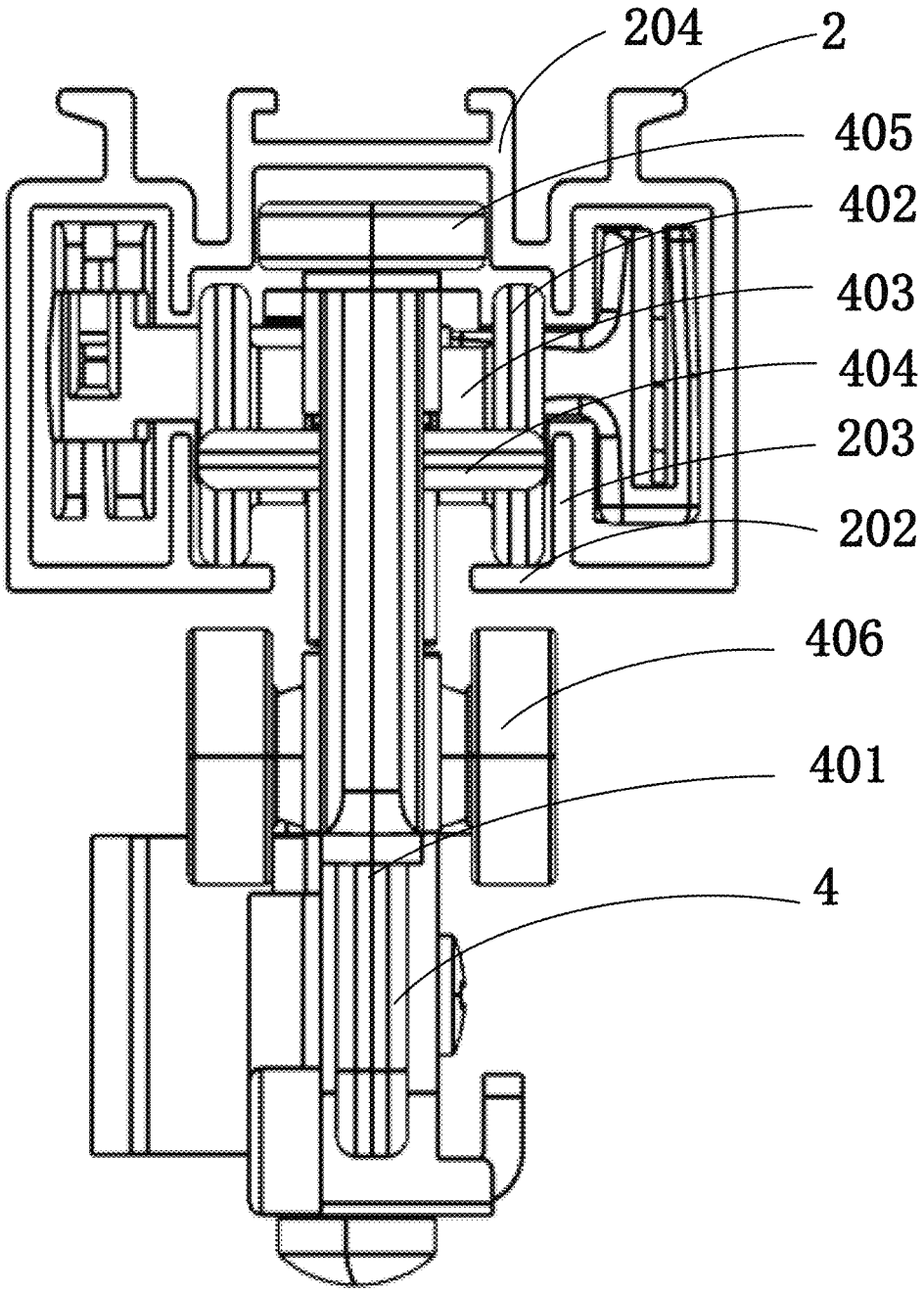
FIG. 20 is a schematic structural diagram of the cooperation of the rail trolley of curtain and the inner rail according to an embodiment of the disclosure.
Figure 21:
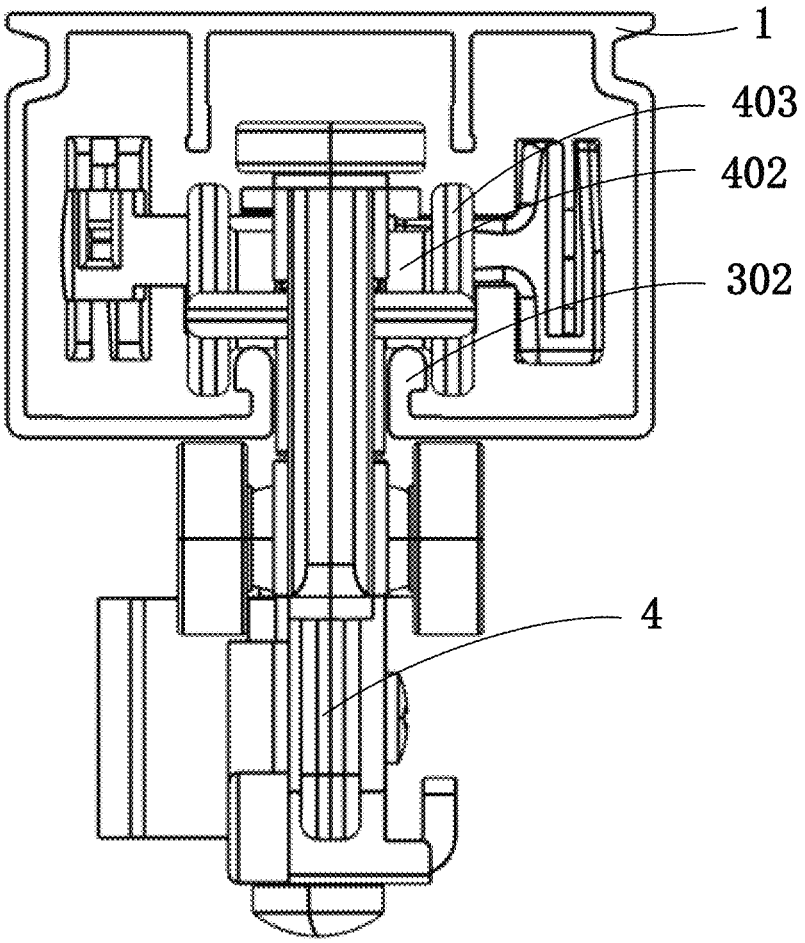
FIG. 21 is a schematic structural diagram of the cooperation of the rail trolley of curtain and the outer rail according to an embodiment of the disclosure.
Figure 22:
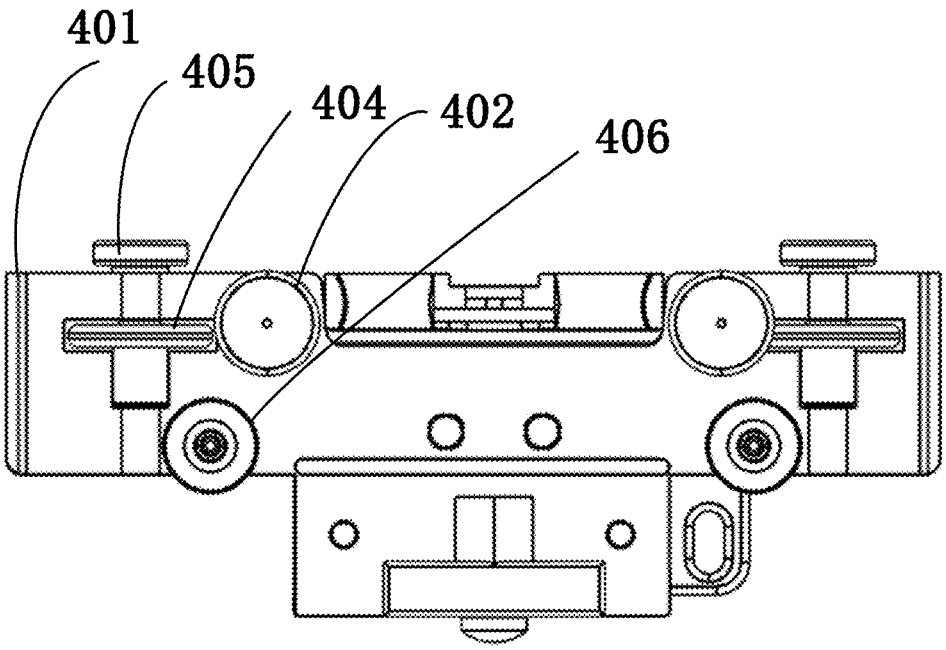
FIG. 22 is a schematic structural diagram of the rail trolley of curtain according to an embodiment of the disclosure.
Figure 23:
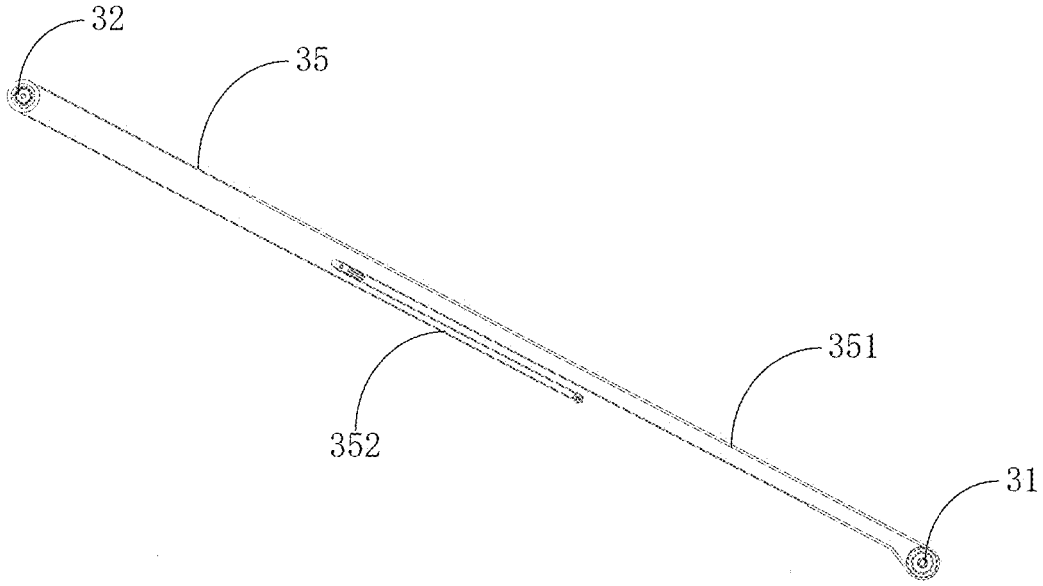
FIG. 23 is a schematic structural diagram of the conveyor belt according to an embodiment of the disclosure.
Figure 24:
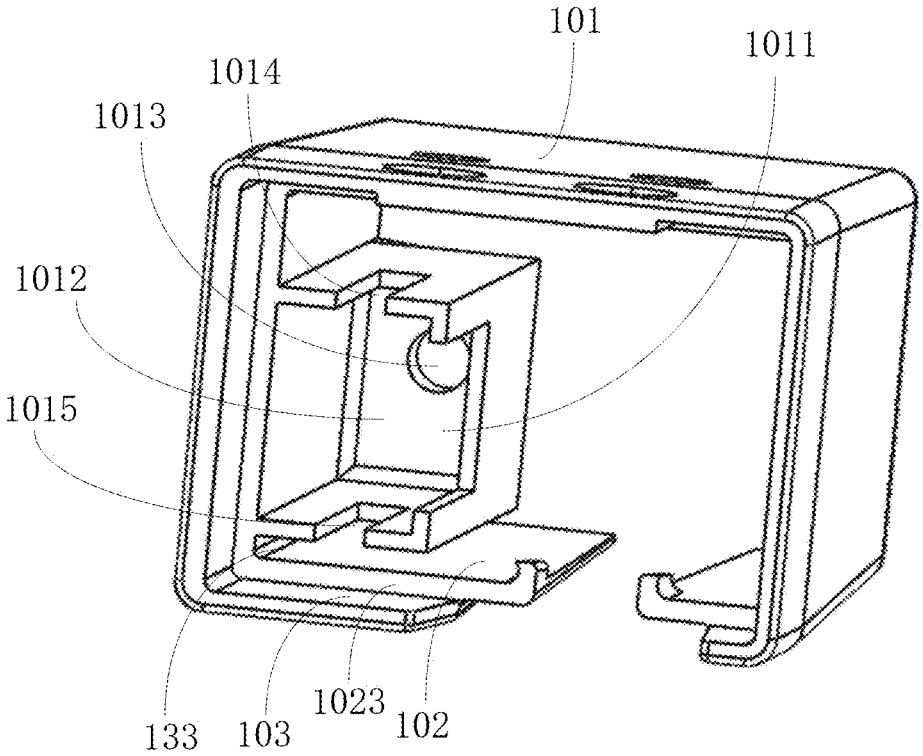
FIG. 24 is a schematic structural diagram of the guide sleeve according to an embodiment of the disclosure.
Figure 25:
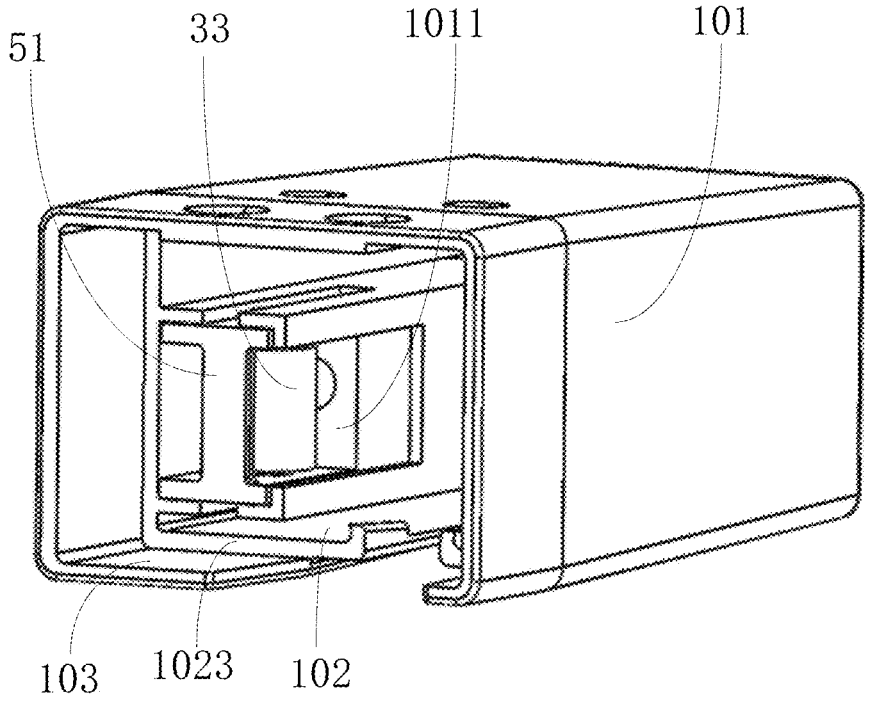
FIG. 25 is a schematic structural diagram of the cooperation between the adjusting component and the adjusting installation groove according to an embodiment of the disclosure.
Figure 26:
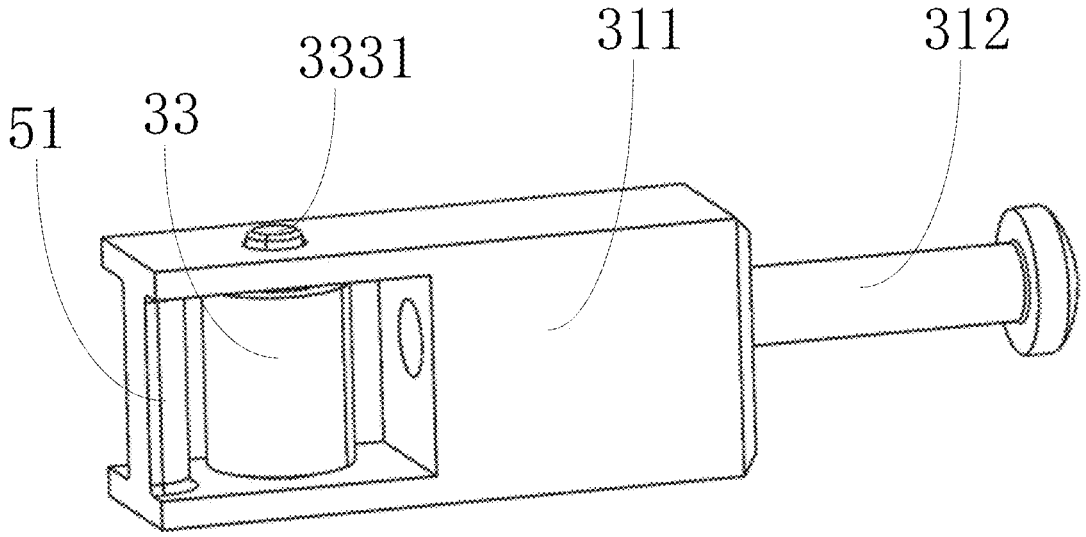
FIG. 26 is a schematic structural diagram of the cooperation between the adjusting component and the first fixed pulley according to an embodiment of the disclosure.
Figure 27:
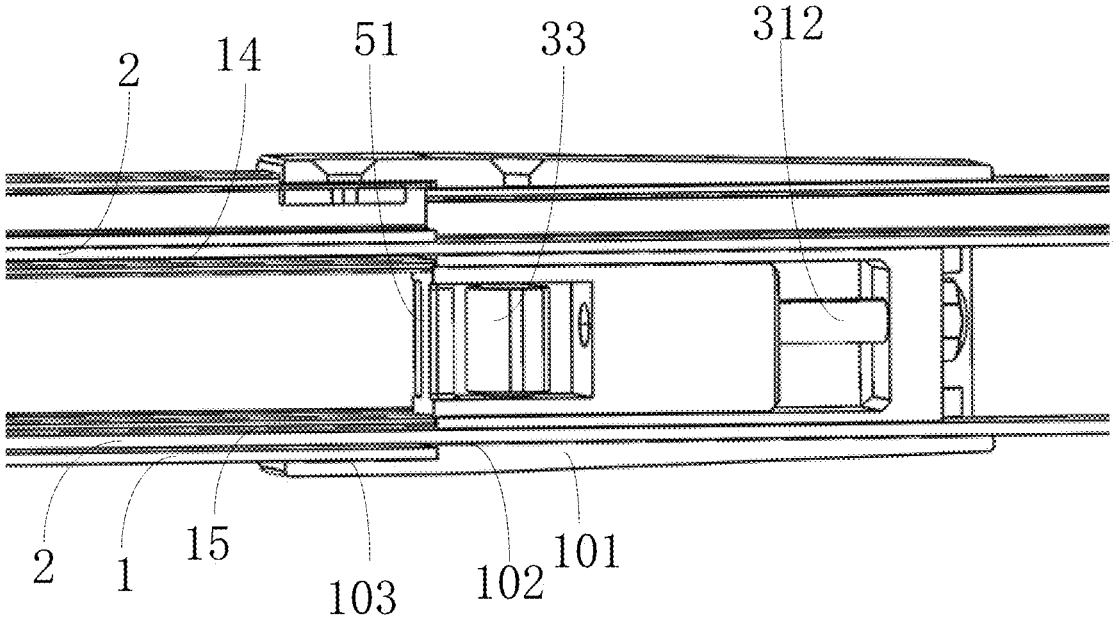
FIG. 27 is a schematic structural diagram of the cooperation of the inner rail, the outer rail and the guide sleeve according to an embodiment of the disclosure.
Figure 28:
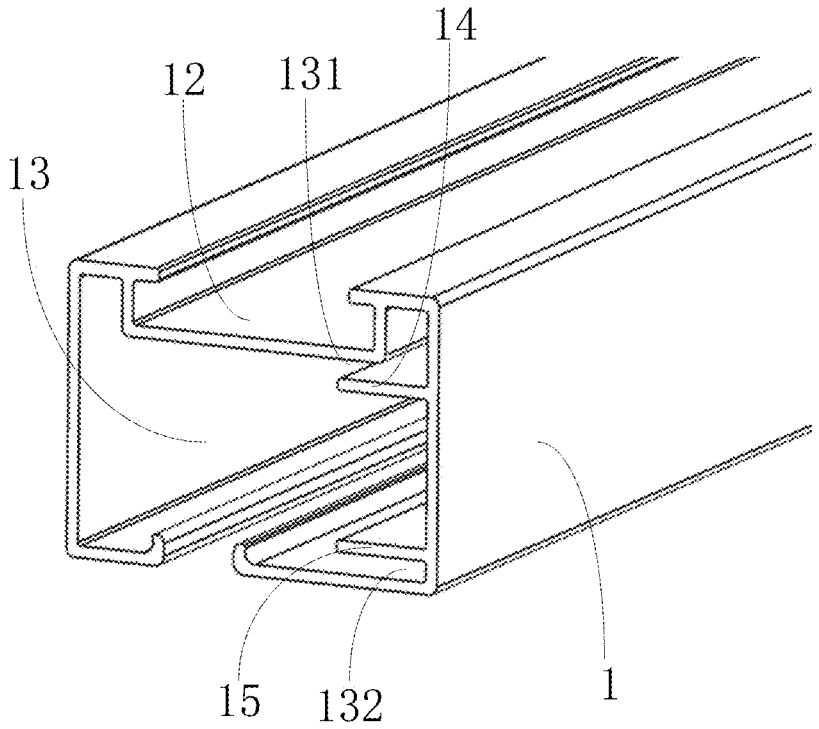
FIG. 28 is a schematic structural diagram of the outer rail according to an embodiment of the disclosure.
Figure 29:
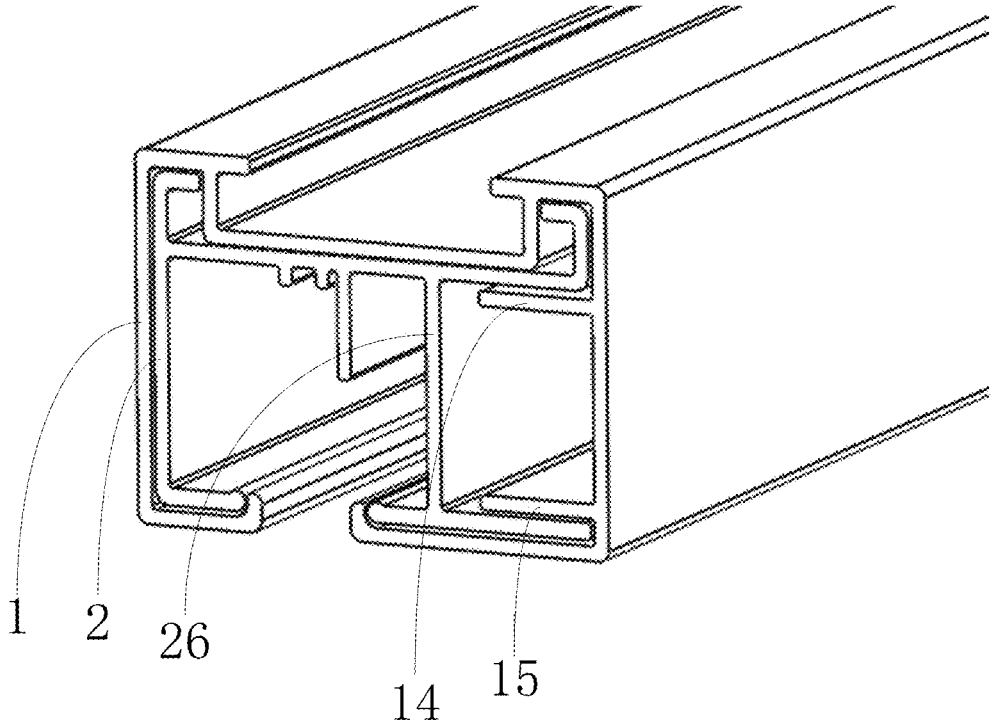
FIG. 29 is a schematic structural diagram of the cooperation between the outer rail and the inner rail according to an embodiment of the disclosure.
Figure 30:
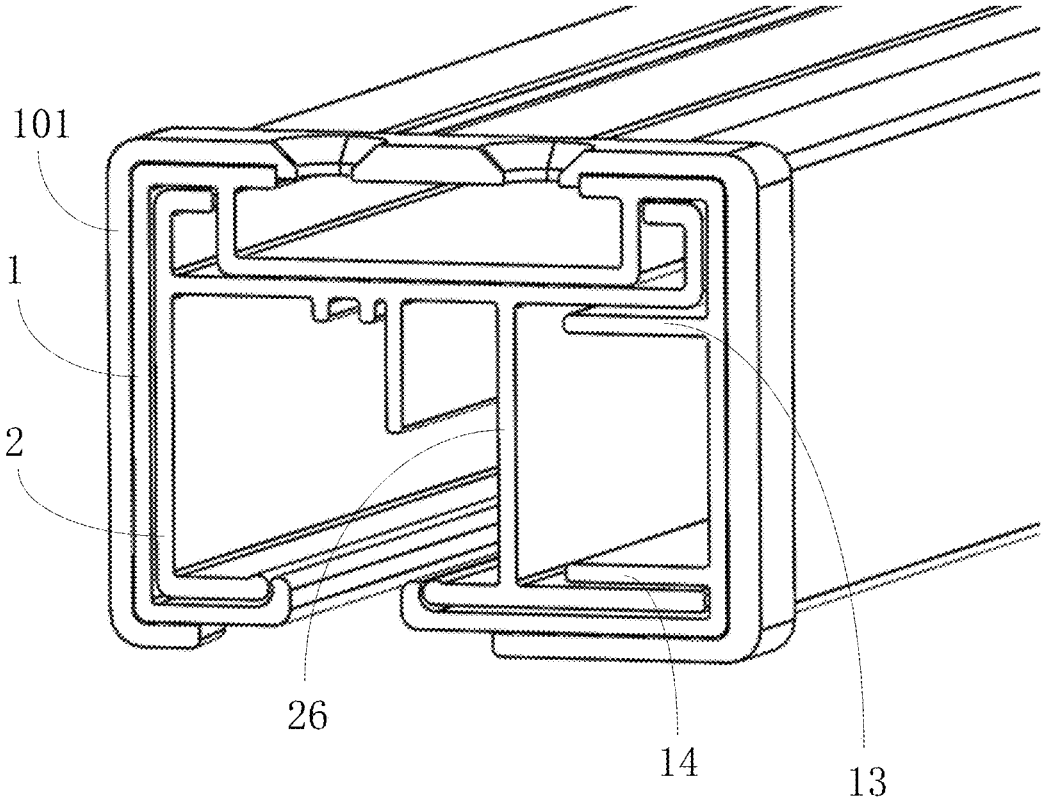
FIG. 30 is a schematic structural diagram of the cooperation of the inner rail, the outer rail and the guide sleeve according to an embodiment of the disclosure.
Figure 31:
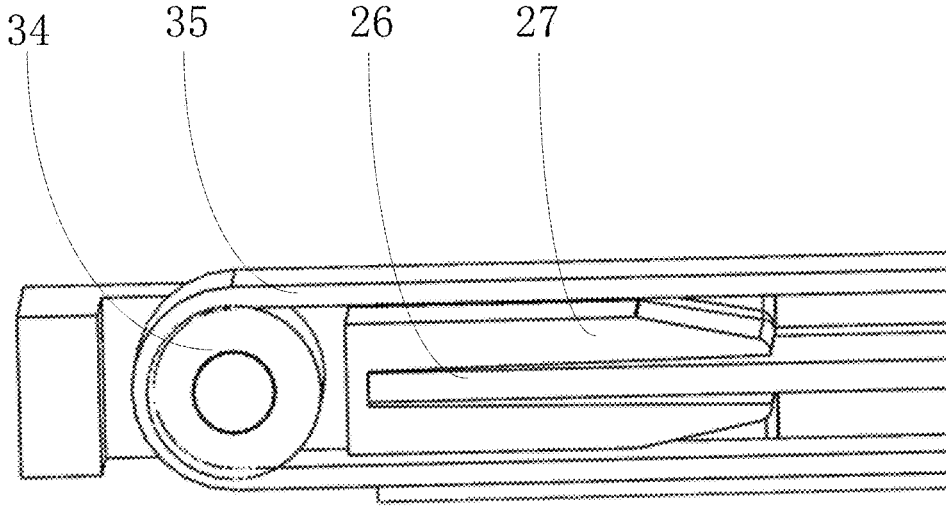
FIG. 31 is a schematic structural diagram of the cooperation of the second fixed pulley and the first side wall according to an embodiment of the disclosure.
Figure 32:
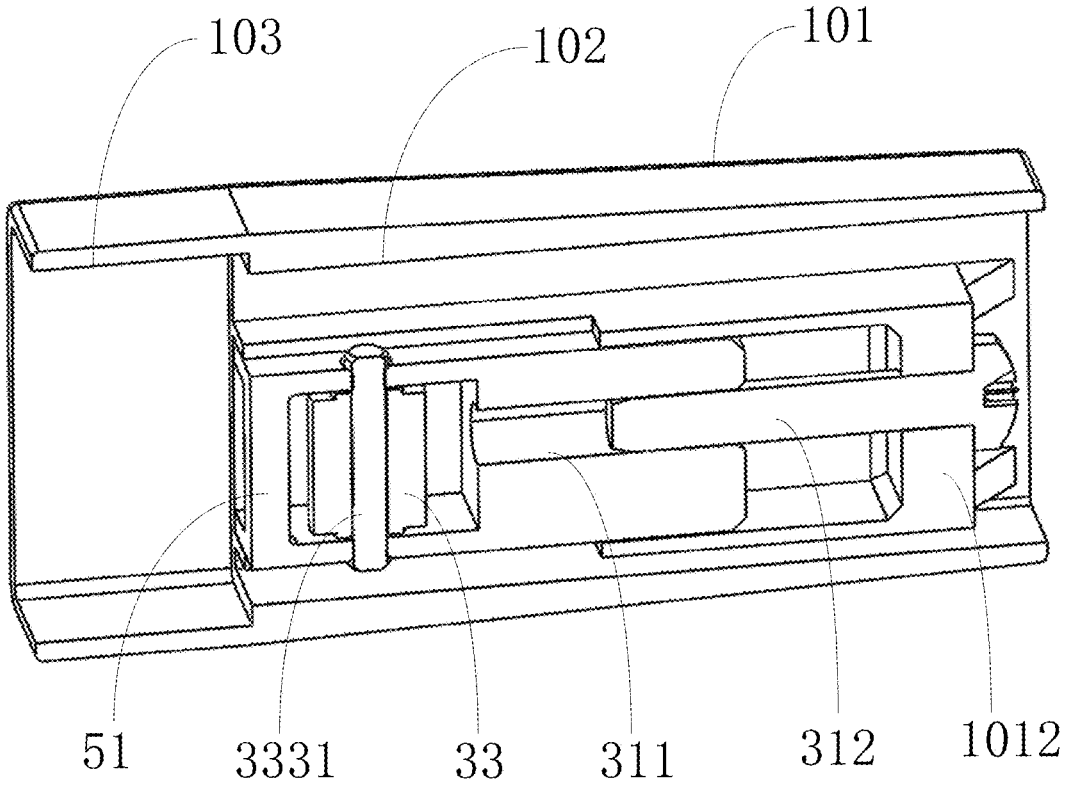
FIG. 32 is a schematic sectional diagram of the cooperation between the adjusting component and the guide sleeve according to an embodiment of the disclosure.

As shown in FIG. 6, the first fixed pulley of the embodiment is fixed on the outer rail 1 through a first fixed part, the first fixed part covers outsides of the inner rail 2 and the outer rail 1, the first fixed part covering the outside of the inner rail 2 extends into the fixed pulley receiving chamber 21 to fix a central axis of the first fixed pulley, and the first fixed part covering the outside of the outer rail 1 is fixed at the outside of the outer rail 1 through fixed screws. It is precisely because the first fixed pulley is fixed at the end of the contact between the outer rail 1 and the inner rail 2, and the first fixed pulley is located in the fixed pulley receiving chamber 21 and needs to be fixed with the outer rail 1, therefore, the application skillfully leads the first fixed pulley out of the fixed pulley receiving chamber 21 and fixed at the upper end of the outer rail 1 with the help of a special first fixed part structure. Specifically, as described in FIG. 6, the first fixed part 331 covers the outer side of the outer rail 1 and the inner rail 2 as a whole, the first fixed part 331 covering the outer side of the inner rail 2 contains two horizontal fixed plates in the fixed pulley receiving chamber, which respectively fix the upper and lower ends of the central shaft of the first fixed pulley, and the first fixed part covering the top of the outer rail 1 is provided with two screw holes, the two fixed screws respectively penetrate through the two screw holes to fix the first fixed part on the upper end of the outer rail 1. To sum up, the first fixed part is just located at the connection between the inner rail 2 and the outer rail 1 and is fixed on the outer rail 1, while the first fixed part located in the fixed pulley receiving chamber 21 is used to fix the central axis of the first fixed pulley.

Figure 2:
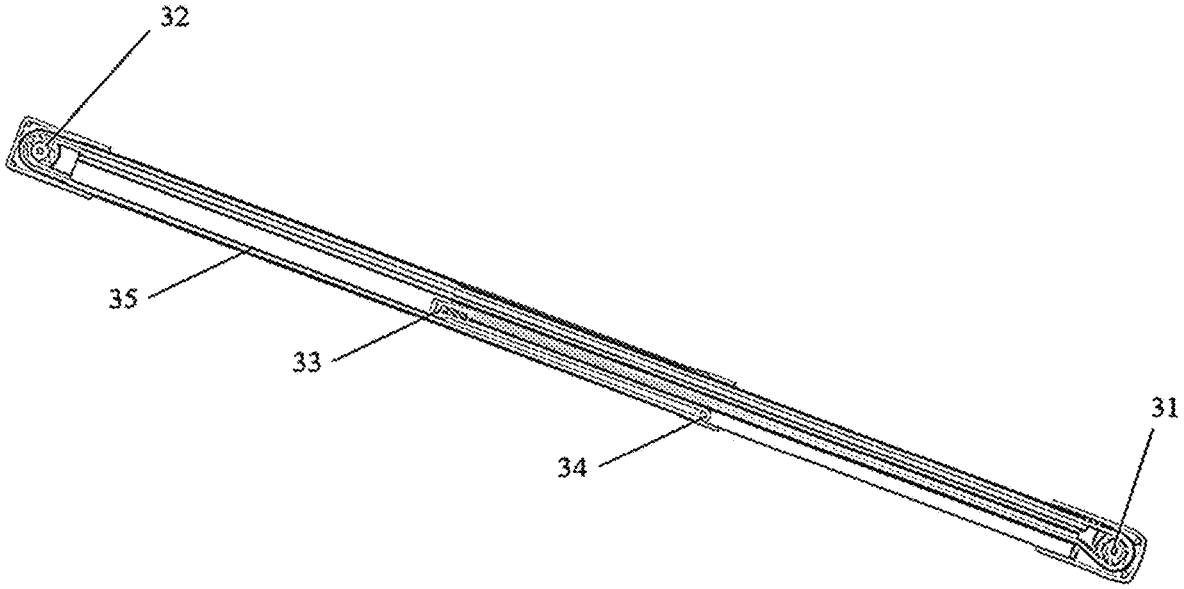
FIG. 2 is a schematic structural diagram of the winding of the conveyor belt according to an embodiment of the disclosure.
Figure 3:
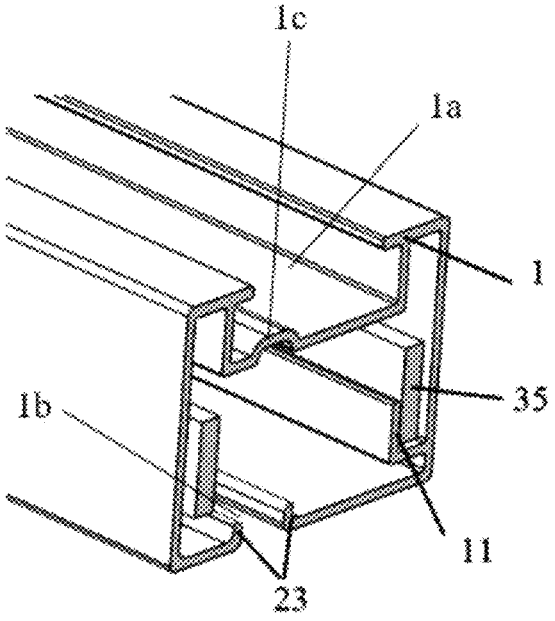
FIG. 3 is a schematic sectional diagram of the outer rail according to an embodiment of the disclosure.
Figure 4:
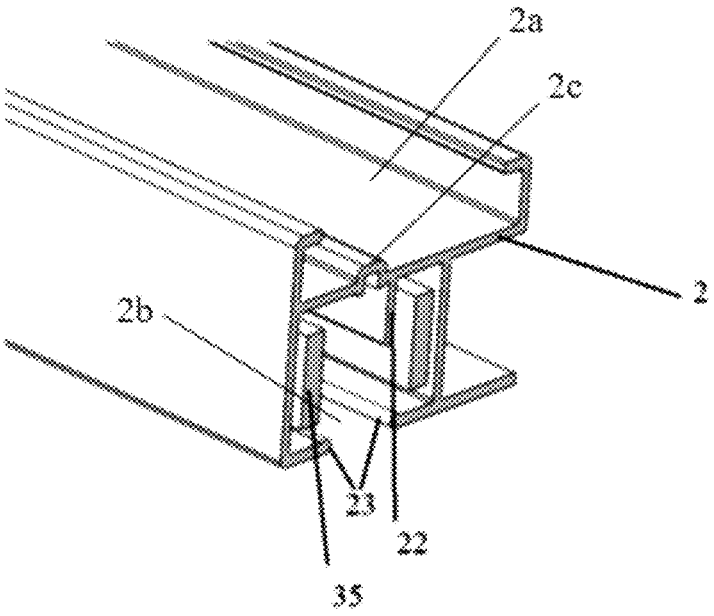
FIG. 4 is a schematic sectional diagram of the inner rail according to an embodiment of the disclosure.
Figure 5:
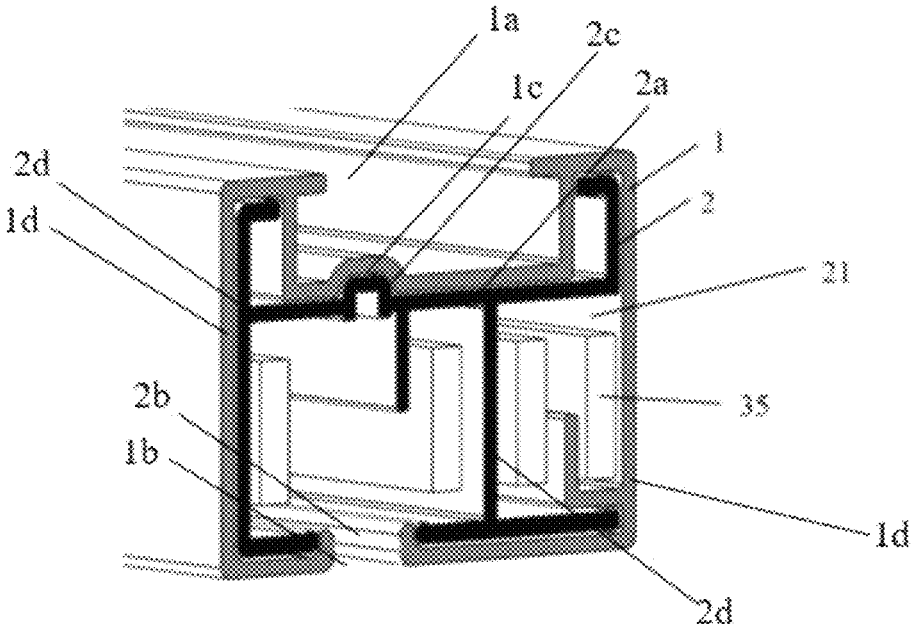
FIG. 5 is a schematic sectional diagram of the outer rail and the inner rail from a first view angle according to an embodiment of the disclosure.

The central axis of the second fixed pulley is fixed on a side wall of the lower-end second opening groove close to the fixed pulley receiving chamber 21 through a second fixed part, and the central axis of the second fixed pulley and the side wall of the lower-end second opening groove close to the fixed pulley receiving chamber 21 are located in a same plane. To sum up, the first fixed pulley is located in the fixed pulley receiving chamber 21, and the second fixed pulley is located on the side of the fixed pulley receiving chamber 21 close to the lower-end second opening groove, that is, the central axis of the second fixed pulley and the side wall of the lower-end second opening groove close to the fixed pulley receiving chamber 21 are located in the same plane. The overall winding mode of the conveyor belt is shown in FIG. 2.

In an illustrated embodiment, the conveyor belt is connected with a belt buckle, a lower end of the belt buckle is connected with a rail trolley of curtain (also referred to as curtain slider, curtain mover), and the rail trolley of curtain is connected with a curtain cloth. When the motor drives the driving wheel to rotate, the driving wheel drives the conveyor belt to rotate, and then drives the curtain cloth to move, so as to realize the opening and closing of the curtain cloth.

The unique winding structure adopted by the disclosure ensures that the length of the conveyor belt remains unchanged and the conveyor belt is always in a tensioned state during the opening and closing of the curtain; the curtain guide rail of the disclosure is stretched and retracted to drive the positions of two fixed pulleys to change at the same time, the stretching and retracting operation is simple, the floor area is small, it is conducive to mass industrial production, has a wide range of application, and reduces the transportation cost and production cost.

Refer to FIG. 7 to FIG. 22, the telescopic curtain guide rail of the embodiment includes a rail trolley of curtain 4, the rail trolley of curtain 4 is connected to the conveyor belt 35 and extends out of the outer rail 1 (also referred to as outer guide rail) and the inner rail 2 (also referred to as inner guide rail), the rail trolley of curtain 4 is fixed at a lower end of the conveyor belt 35, the rail trolley of curtain 4 is movable along an axial direction of the outer rail 1 and the inner rail 2 driven by the conveyor belt 35.

Refer to FIG. 7 to FIG. 22, in an illustrated embodiment, the rail trolley of curtain 4 includes a trolley body 401, a plurality of first pulleys 402 and a plurality of second pulleys 403, the plurality of first pulleys 402 and the plurality of second pulleys 403 are rotatably connected to the trolley body 401, the trolley body 401 includes an upper main body (also referred to as upper trolley body) and a lower main body (also referred to as lower trolley body) connected to the upper main body, both sides of the upper main body are provided with the plurality of first pulleys 402 and the plurality of second pulleys 403, bottoms of the plurality of first pulleys 402 form a first sliding surface, bottoms of the plurality of second pulleys 403 form a second sliding surface, and the second sliding surface is higher than the first sliding surface.

In an illustrated embodiment, the inner rail 2 is provided with a first sliding support surface 202, the outer rail 3 is provided with a second sliding support surface 302, when the rail trolley of curtain 4 slides in the inner rail 2, one of the first pulley 402 and the second pulley 403 is supported on the first sliding support surface 202, or when the rail trolley of curtain 4 slides in the outer rail 1, the other one of the first pulley 402 and the second pulley 403 is supported on the second sliding support surface 302; and a height difference between the first sliding support surface 202 and the second sliding support surface 302 is matched with a height difference between the second sliding surface and the first sliding surface.

The technical principle of the embodiment: the inner rail 2 and the outer rail 1 are respectively provided with the first sliding support surface 202 and the second sliding support surface 302; the first pulleys 402 arranged on the rail trolley of curtain form the first sliding surface, and the second pulleys 403 arranged on the rail trolley of curtain form the second sliding surface, the height difference between the first sliding support surface 202 and the second sliding support surface 302 is adapted to the height difference between the second sliding surface and the first sliding surface to eliminate the influence of the height difference between the inner rail 2 and the outer rail 3 on the movement of the rail trolley of curtain (also referred to as curtain rail trolley, curtain mover, curtain slider).

Each of the bottom of the first pulley 402 and the bottom of the second pulley 403 refers to one end surface of the supporting pulley of the rail trolley of curtain when in use. The first sliding surface can be understood as that ends of the supporting the plurality of first pulleys 402 is in the same horizontal plane, and the second sliding surface can be understood as that ends of the supporting the plurality of second pulleys 403 is in the same horizontal plane. The first sliding support surface 202 refers to a support surface arranged in the inner rail 2 and matched with the first sliding surface. When the rail trolley of curtain moves in the inner rail, the support surface plays a supporting role against the bottoms of the first pulleys. The second sliding support surface 302 refers to a support surface arranged in the outer rail 1 and matched with the second sliding surface. When the rail trolley of curtain moves in the outer rail, the support surface plays a supporting role against the bottoms of the second pulleys.

As shown in FIG. 7 to FIG. 22, in an illustrated embodiment, the first pulley 402 is arranged coaxially with the second pulley 403, and a radius of the first pulley 402 is greater than that of the second pulley 403; or the first pulley 402 and the second pulley 403 have different rotation axes, the rotation axes of the first pulley 402 and the second pulley 403 are parallel and have a same height, and a radius of the first pulley 402 is greater than that of the second pulley 403. The radius of the first pulley 402 is larger than that of the second pulley 403, when used with the curtain guide rail, it cooperates with the first sliding support surface 202 and the second sliding support surface 302, when the rail trolley of curtain is located on the outer rail 1, the first pulley 402 has the function of limiting both sides of the rail trolley of curtain because the diameter of the first pulley 402 is larger than that of the second pulley 403 and the distance between them is smaller.

As shown in FIG. 7 to FIG. 22, in an illustrated embodiment, the first pulley 402 is arranged coaxially with the second pulley 403, or the first pulley 402 and the second pulley 403 have different rotation axes, the first pulley 402 and the second pulley 403 are arranged in a staggered manner in an axial direction of the first pulley 402 and the second pulley 403, correspondingly, the first sliding support surface 202 and the second sliding support surface 302 are arranged in a staggered manner in the axial direction of the first pulley and the second pulley. Coaxial setting or parallel design of rotating shafts makes the structure of the rail trolley of curtain more compact and more convenient for production and installation. The staggered setting of the first sliding support surface 202 and the second sliding support surface 302 matches the setting of the first pulley 402 and the second pulley 403, so as to solve the problem of unstable operation between the inner rail 2 and the outer rail 1 of the rail trolley of curtain.

In an illustrated embodiment, as shown in FIG. 7 to FIG. 22, the first pulley 402 is arranged coaxially with the second pulley 403, the first pulley 402 is close to the trolley body 401, the second pulley 403 is located on a side of the first pulley 402 facing away from the trolley body 401, and the first pulley 402 is integrally formed with the second pulley 403. The integrated design makes the structure of the rail trolley of curtain more compact, saves materials and is more convenient for production and installation.

As shown in FIG. 7 to FIG. 22, in an illustrated embodiment, the rail trolley of curtain 4 further includes a plurality of first guide wheels 404, the first guide wheel 404 is rotatably connected to the upper main body, the first guide wheel 404 transversely penetrates through the upper main body and wheel edges of the plurality of first guide wheels protrude outward relative to sides of the upper main body in a transverse direction, the plurality of first guide wheels 404 are rotatable in the transverse direction, and the first guide wheel 404 is higher than the second sliding support surface 302.

As shown in FIG. 7 to FIG. 22, in an illustrated embodiment, the rail trolley of curtain 4 further includes a plurality of second guide wheels 405, the second guide wheel 405 is installed on a top of the upper main body and rotatable in the transverse direction, wheel edges of the second guide wheel 405 protrude outward relative to the sides of the upper main body in the transverse direction, the second guide wheel is higher than the first guide wheel 404, and a radius of the second guide wheel 405 is different from that of the corresponding first guide wheel 404.

As shown in FIG. 7 to FIG. 22, in an illustrated embodiment, the inner rail 2 is provided with a first guide groove 203 therein, the outer rail 1 is provided with a second guide groove 204 therein; when the rail trolley of curtain 4 slides in the inner rail 2, one of the first guide wheel 404 and the second guide wheel 405 is located in the first guide groove 203 and matched with the first guide groove 203, or when the rail trolley of curtain 4 slides in the outer rail 1, the other one of the first guide wheel 404 and the second guide wheel 405 is located in the second guide groove 204 and matched with the second guide groove 204; widths of the first guide groove 203 and the second guide groove 204 are different, and a width difference between the first guide groove 203 and the second guide groove 204 is matched with a diameter difference between the first guide wheel 404 and the corresponding second guide wheel 405. The transverse limit of the rail trolley of curtain can be realized through the combination of the guide wheel and the guide groove, so that the rail trolley of curtain can run smoothly in the transverse direction.

As shown in FIG. 7 to FIG. 22, in an illustrated embodiment, the plurality of first pulleys 402 have a same size and are symmetrically arranged on two sides of the trolley body 401, and the plurality of second pulleys 403 have a same size and are symmetrically arranged on the two sides of the trolley body 401. The rail trolley of curtain 4 further includes a plurality of outer pulleys 406 arranged on the two sides of the trolley body 401 in pairs, and the plurality of outer pulleys 406 are located below the first sliding surface and is spaced a predetermined height from the first sliding surface. The outer pulley 406 can make the rail trolley of curtain transition smoothly between the inner rail 2 and the outer rail 1, and can limit the upward movement of the rail trolley of curtain.

As shown in FIG. 7 to FIG. 22, in an illustrated embodiment, the rail trolley of curtain 4 includes the trolley body 401 and a plurality of pulleys, the trolley body 401 includes an upper main body and a lower main body connected to the upper main body, the upper main body is rotatably installed with the plurality of pulleys, the upper main body is provided with first threading through holes 407, the lower main body is provided with the second threading through holes 408.

As shown in FIG. 7 to FIG. 22, in an illustrated embodiment, the conveyor belt 35 includes a first conveyor belt and a second conveyor belt, the second conveyor belt is engaged with the driving wheel 31 or the driven wheel 32, the first conveyor belt is a rope, the first conveyor belt is connected to the second conveyor belt in an annular shape and sleeved on the driving wheel 31 and the driven wheel 32 to make the driving wheel 31 in transmission connection with the driven wheel 32. The rail trolley of curtain 4 is connected to the first conveyor belt and move on the outer rail 1 and/or the inner rail 2 driven by the first conveyor belt, the upper main body of the rail trolley of curtain 4 is slidable in the outer rail 1 and/or the inner rail 2, the lower main body of the rail trolley of curtain 4 is located outside the outer rail 1 and the inner rail 2, the first conveyor belt sequentially passes through the first threading through holes 407 and the second threading through holes 408 to be fixed on the rail trolley of curtain 4.

As shown in FIG. 7 to FIG. 22, in an illustrated embodiment, the first threading through hole 407 and the second threading through hole 408 of the rail trolley of curtain 4 are generally used together with the conveyor belt 35. The conveyor belt 35 can be composed of the first conveyor belt and the second conveyor belt. Generally, the first conveyor belt is a steel wire rope 501, the second conveyor belt is a synchronous belt 502, and the curtain guide rail is generally a curtain guide rail with relatively stretched and retracted sliding between the outer rail 1 and the inner rail 2. Threading mode of the steel wire rope 501 on the rail trolley of curtain 4: the steel wire rope 501 sequentially passes through the first end opening 4071 of the first threading through hole 407, the second end opening 4072 of the first threading through hole 407, the third threading through hole 409, the second through hole upper opening 4081 of the second threading through hole 408 and the second through hole lower opening 4082 of the second threading through hole 408, and then is fixed with the threading fixed device 411.

As shown in FIG. 7 to FIG. 22, in an illustrated embodiment, the curtain guide rail is generally provided with a synchronous wheel, a driven wheel, a conveyor belt 35 and a plurality of rail trolley of curtains 4. The synchronous wheel and the driven wheel are respectively fixed on both ends of the curtain guide rail, and the lower main body of the rail trolley of curtain 4 extends out of the curtain guide rail. The synchronous belt 502 is disposed on one end of the synchronous wheel (also referred to as second rotating wheel 7), The synchronous belt is sequentially connected with the synchronous wheel, the rail trolley of curtain 4, the driven wheel (also referred to as first rotating wheel 6) and the synchronous wheel to form a ring. A number of rail trolley of curtain 4 can be a plurality of rail trolley of curtains 4, which are connected with the steel wire rope 501 and the synchronous belt 502, and any one of them is connected with the steel wire rope 501 through the first threading through hole 407 and the second threading through hole 408. When the length of the curtain guide rail needs to be adjusted, loosening the threading fixed device 411, pulling the steel wire rope 501 through the first threading through hole 407 of the lower main body, changing the length of the steel wire rope 501 inside the curtain guide rail, so as to change the length of the curtain guide rail, and tightening the threading fixed device 411 after adjustment. The lead structure of the rail trolley of curtain 4 is matched with the curtain guide rail to realize the stretching and retracting of the curtain guide rail, so as to avoid increasing the size of the curtain guide rail. Since one end of the through hole of the lower main body extends outside the curtain guide rail, the length of the steel wire can be temporarily changed through the through hole of the lower main body and the threading fixed device 411, making the adjustment operation convenient and easy, further, the relative positions of the adjacent rail trolley of curtains 4 can be quickly changed to meet the requirements of double opening curtains.

As shown in FIG. 7 to FIG. 22, in an illustrated embodiment, the first conveyor belt includes a first rope section and a second rope section, the first rope section and the second rope section are separated from each other, and a first end of the first rope section is connected with a first end of the second conveyor belt, a second end of the first rope section passes through the first threading through hole 407 and the second threading through hole 408 and is fixed on the rail trolley of curtain 4, a first end of the second rope section is connected with a second end of the second conveyor belt, and a second end of the second rope section passes through the first threading through hole 407 and the second threading through hole 408 and is fixed on the rail trolley of curtain 4.

In an illustrated embodiment, the first conveyor belt is a steel wire rope 501, and the second conveyor belt is a synchronous belt 502. The steel wire rope 501 includes a first steel wire rope section and a second steel wire rope section. The first steel wire rope section and the second steel wire rope section are separated each other, and two first threading through holes 407 and two second threading through holes 408 are arranged correspondingly; the first steel wire rope section passes through the first threading through hole 407 and the second threading through hole 408, and the second steel wire rope section passes through the other first threading through hole 407 and the other second threading through hole 408. Through the above setting, the length of the steel wire rope 501 in the telescopic curtain guide rail can be easily and quickly adjusted.

As shown in FIG. 7 to FIG. 22, in an illustrated embodiment, the rail trolley of curtain 4 further includes a threading fixed device 411, the threading fixed device 411 is disposed on a side of the lower main body close to the second threading through holes 408 or the threading fixed device 411 is disposed in the second threading through holes 408, and the threading fixed device 411 fixes the second end of the first rope section and the second end of the second rope section onto the rail trolley of curtain 4.

The threading fixed device 411 is disposed in the second threading through hole 408, which means that the threading fixed device 411 is partially or completely disposed in the second threading through holes 408, and the steel wire rope 501 can be fixed by cooperating with the second threading through hole 408. In an embodiment, the threading fixed device 411 is a hole, ring, threading bolt structure, elastic structure, clamping structure and clamping structure arranged on the lower main body, and the steel wire rope 501 can be fixed on the lower main body through the threading fixed device 411. In an embodiment, the threading fixed device 411 may not be provided, but the steel wire rope 501 may be fixed by winding or knotting in the second threading through hole 408.

As shown in FIG. 7 to FIG. 22, in an illustrated embodiment, the second threading through hole 408 is a threading bolt hole arranged on the lower main body in a vertical direction, the second threading through hole 408 includes a second through hole upper opening and a second through hole lower opening 4082, the second through hole lower opening 4082 is disposed on a bottom of the lower main body; the threading fixed device 411 includes threading bolts 4111 and threading nuts 4112, the threading bolts 4111 are matched with the second threading through holes 408 respectively, the threading nuts 4112 are matched with the second through hole upper openings; the second end of the first rope section and the second end of the second rope section are fixed on the rail trolley of curtain 4 by cooperation of the threading bolts 4111 and threading nuts 4112. Through the cooperation of threading bolts 4111 and threading nuts 4112, the steel wire rope 501 can be better fixed in the second threading through hole 408. The operation of adjusting steel wire rope 501 can be easily carried out by tightening and loosening the threading bolts 4111 and the threading nuts 4112.

As shown in FIG. 7 to FIG. 22, in an illustrated embodiment, portions of the first conveyor belt are distributed on two sides of the trolley body 401 of the rail trolley of curtain 4. In an illustrated embodiment, the first conveyor belt is generally a steel wire rope 501, the steel wire rope 501 sequentially passes through the first threading through hole 407 and the second threading through hole 408. Since any one of the first threading through hole 407 and the second threading through hole 408 is a threading through hole transversely penetrating through the trolley body 401, the steel wire rope 501 is distributed on both sides of the trolley body 401, making it easier for the steel wire rope 501 to pull and fix.

As shown in FIG. 7 to FIG. 22, in an illustrated embodiment, the trolley body 401 of the rail trolley of curtain 4 is further provided with third threading through holes 409, the third threading through holes 409 transversely penetrate through the trolley body 401 of the rail trolley of curtain 4, and the first conveyor belt passes through the first threading through hole 407, the third threading through hole 409 and the second threading through hole 408 sequentially in that order. Specifically, the third threading through hole 409 is disposed between the first threading through hole 407 and the second threading through hole 408, and the third threading through hole 409 transversely penetrates through the trolley body 401. The setting of the third threading through holes 409 can make the steel wire rope 501 fit the trolley body 401.

As shown in FIG. 7 to FIG. 22, in an illustrated embodiment, the first threading through hole 407 includes a first end opening 4071 and a second end opening 4072 connected with the first end opening 4071, the first end opening 4071 is disposed on one side of the upper main body, and the second end opening 4072 is disposed on the other side of the upper main body; the first end opening 4071 disposed on the one side surface of the upper main body is higher than ones of the plurality of pulleys disposed on the one side surface of the upper main body and outward protruding parts of the ones of the plurality of pulleys disposed on the one side surface of the upper main body, and the second end opening 4072 disposed on the other side of the upper main body is lower than the others of the plurality of pulleys disposed on the other side of the upper main body and outward protruding parts of the others of the plurality of pulleys disposed on the other side of the upper main body. The portions of the conveyor belt from the first end opening 4071 to the first rotating wheel 6 and from the first end opening 4071 to the second rotating wheel 7 is higher than the pulleys located on the same side and the outward protruding part of the pulleys located on the same side.

The pulleys of the trolley body 401 includes the first pulleys 402, the second pulleys 403, the first guide pulleys 404 and the second guide pulleys 405. The first guide wheel 404 and the second guide wheel 405 are rotatably connected to the upper main body, the first guide wheel 404 transversely penetrates through the upper main body, and in the transverse direction, the wheel edges of the first guide wheels 404 protrude outward relative to the sides of the upper main body; the first pulley 402 and the second pulley 403 are rotatably connected to both sides of the upper main body 401. The above pulleys located on the same side refers to the first pulleys 402 and the second pulleys 403 are located on the same side; the outward protruding parts of the pulleys located on the same side refers to the outward protruding parts of the first guide wheels 404 and the second guide wheels 405 with respect to the sides of the upper main body. This arrangement can reduce the transverse dimension of the rail trolley of curtain 4 and separate the pulleys of the rail trolley of curtain 4 from the steel wire rope 501 to avoid the steel wire rope 501 blocking and winding the rail trolley of curtain 4 during operation.

As shown in FIG. 7 to FIG. 22, in an illustrated embodiment, the first threading through hole 407 is an arc through hole transversely penetrating through the trolley body 401, and the first end opening 4071 and the second end opening 4072 are disposed on the two sides of the trolley body 401 in a staggered manner. The first threading through hole 407 is an arc through hole, or the middle part of the first threading through hole 407 is an arc through hole; When the steel wire rope 501 is adjusted through the arc-shaped through hole, the pulling is smoother; the staggered setting of the first end opening 4071 and the second end opening 4072 can reduce the transverse size of the curtain guide pulley 4, and optimize the transverse and longitudinal stress of the steel wire rope 501 and the threading through hole, making it easier for the steel wire rope 501 to pull and fix.

As shown in FIG. 7 to FIG. 22, in an illustrated embodiment, the telescopic curtain guide rail further includes a curtain guide rail fixed device 100, the curtain guide rail fixed device 100 includes a guide sleeve 101, and the guide sleeve 101 is hollow tubular structure with openings at both ends, and the guide sleeve 101 is sleeved outside a connection between the outer rail 1 and the inner rail 2, the connecting end of the outer rail 1 is inserted into the guide sleeve 101 from the second end of the guide sleeve 101 and matched with the guide sleeve 101, the free end of the outer rail 1 extends out from the guide sleeve 101, the inner rail 2 is inserted into the guide sleeve 101 from the first end of the guide sleeve 101 and matched with the guide sleeve 101, and the connecting end of the inner rail 2 is inserted into the outer rail 1, the free end of the inner rail 2 extends out of the guide sleeve 101, and the rail trolley of curtain 4 can pass through the guide sleeve 101 when moves between the outer rail 1 and the inner rail 2.

In an illustrated embodiment, the upper main body of the rail trolley of curtain 4 is located in the outer rail 1 and the inner rail 2, the lower main body of the rail trolley of curtain 4 is located outside the outer rail 1 and the inner rail 2, and the upper main body and the lower main body move along both ends of the inner rail 2 and the outer rail 1. When in use, the length of the conveyor belt is fixed, which can limit the stretching of the curtain guide rail, when used in conjunction with the curtain guide rail fixed device 100, the telescopic curtain guide rail can be fixed to prevent it from stretching and retracting inward. The free ends of the outer rail 1 and the inner rail 2 refer to the ends of the outer rail 1 and the inner rail 2 relative to the ends matching with the guide sleeve 101.

As shown in FIG. 7 to FIG. 22, in an illustrated embodiment, a bottom surface of the guide sleeve 101 is provided with a first support surface 102 and a second support surface 103, the first support surface 102 extends inward along an axial direction of the guide sleeve 101 from the first end of the guide sleeve 101, the second support surface 103 extends inward along the axial direction of the guide sleeve 101 from the second end of the guide sleeve 101, the first support surface 102 is connected with the second support surface 103, the first support surface 102 is higher than the second support surface 103, and a step is formed at a connection between the first support surface 102 and the second support surface 103, the first support surface 102 supports the inner rail 2, the second support surface 103 supports the outer rail 1, the outer rail 1 abuts against at the step, a height difference of bottom surfaces of the outer rail 1 and the inner rail 2 is matched to a height difference between the second support surface 103 and the first support surface 102. The outer rail 1 abuts against at the step here can be understood as that the outer rail 1 is connected with the step, and the step resists the movement of the outer rail 1 to the first end of the guide sleeve 101. The first support surface 102 is higher than the second support surface 103 with reference to the bottom surface of the guide sleeve 101. The above mentioned higher in the disclosure refers to taking the plane of the outer surface at the bottom of the guide sleeve 101 as a reference.

The second support surface 103 can be matched with the outer rail 1, the outer rail 1 is limited by the step where the first support surface 102 is connected with the second support surface 103, and the first support surface 102 can be matched with the inner guide rail 2, the inner guide rail 2 can slide along the first support surface 102 from the first end of the guide sleeve 101 and extend into the outer rail 1, adjusting the position where the inner rail 2 extends into the outer rail 1 to achieve the required length of the curtain guide rail, then, the curtain guide rail can be fixed with the fixed component 113. The fixed component 113 can match with the guide sleeve 101 to restrict the relative stretching and retracting of the inner rail 2 and the outer rail 1 inward. The curtain guide rail fixed device 100 can also be used in conjunction with curtain guide rail conveying mechanisms such as conveyor belts or conveyor ropes, when the curtain guide rail transmission mechanism is in use, the length of the curtain guide rail transmission mechanism is fixed, which can limit the outward stretching of the curtain guide rail. Therefore, the curtain guide rail fixed device 100 and the curtain guide rail transmission mechanism can fix the telescopic curtain rod guide rail to prevent it from stretching outward and retracting inward.

As shown in FIG. 7 to FIG. 22, in an illustrated embodiment, the bottom surface of the guide sleeve 101 is provided with a through groove 108 penetrating the first support surface 102 and the second support surface 103, a bottom of the inner rail 2 is provided with a first sliding opening 201 along the axial direction, a bottom of the outer rail 3 is provided with a second sliding opening 301 along the axial direction, the first sliding opening 201 is communicated with the second sliding opening 301.

As shown in FIG. 7 to FIG. 22, in an illustrated embodiment, two ends of the through groove 108 are respectively communicated with the first sliding opening 201 and the second sliding opening 301. Specifically, the first sliding opening 201 is wider than the second sliding opening 301 and is a rectangular opening. The first sliding opening 201 and the second sliding opening 301 are respectively arranged at the middles of the bottoms of the inner rail 2 and the bottom of the outer rail 1. The first sliding opening 201 and the second sliding opening 301 are communicated with each other and are communicated with the through groove 108, so that the curtain guide rail components such as the rail trolley of curtain 4 protruding outside the curtain guide rail can move between the inner rail 2 and the outer rail through the guide sleeve 101.

As shown in FIG. 7 to FIG. 22, in an illustrated embodiment, the through groove 108 includes a first through section 109 and a second through section 110, the first through section 109 is communicated with the second through section 110, positions of the first through section 109 and the second through section 110 correspond to positions of the first support surface 102 and the second support surface 103 respectively, a width of the first through section 109 close to the first end of the guide sleeve 101 is greater than a width of the first sliding opening 201, a width of the first through section 109 close to the second through section 110 is matched with the width of the first sliding opening 201.

In an illustrated embodiment, a width of the second through section 110 is matched with a width of the second sliding opening 301. Specifically, the first sliding opening 201 is wider than the second sliding opening 301 and is a rectangular opening. The first sliding opening 201 and the second sliding opening 301 are respectively arranged in the middle of the bottom of the inner rail 2 and the bottom of the outer rail 1. The width of the first sliding opening 201 refers to the distance between its two sides parallel to the axial direction of the inner rail 2; the width of the second sliding opening 301 refers to the distance between its two sides parallel to the axial direction of the outer rail 1. When in use, the width of the first through section 109 close to the first end of the guide sleeve 101 is greater than the first sliding opening 201 of the inner rail 2, and the width of the first through section 109 close to the second through section 110 corresponds to the width of the first sliding opening 201 of the inner rail; the width of the second through section 110 corresponds to the width of the first sliding opening 201 of the outer rail 1. The communication among the through groove 108 of the guide sleeve 101, the first sliding opening 201 of the inner rail 2 and the first sliding opening 201 of the outer rail 1 is smoother, and the curtain guide rail components such as the rail trolley of curtain 4 pass through them more smoothly.

As shown in FIG. 7 to FIG. 22, in an illustrated embodiment, the plurality of second pulleys 403 are rotatably installed on the rail trolley of curtain 4, the guide sleeve 101 further includes transition tables 112, the transition tables 112 protrude upward relative to the first sliding support surface 202, the transition tables are extended outward along the axial direction of the guide sleeve 101 from the connection between the first sliding support surface 202 and the second sliding support surface 302, an inner surface of the bottom of the outer rail 1 is provided with a second sliding support surface 302, the second sliding support surface 302 is axially extended from the connecting end of the outer rail 1 towards the other end of the outer rail 1, the second sliding support surface 302 is higher than the inner surface of the bottom of the outer rail 1; when the outer rail 1 is matched with the guide sleeve 101, the transition tables 112 are butted and matched with the second sliding support surface 302 in the axial direction of the guide sleeve 101, and the second sliding support surface 302 is higher than the transition tables 112, the second pulley 403 can slidable upward from the transition table 112 to the second sliding support surface 302 or downward from the second sliding support surface 302 to the transition table 112.

The height of the transition table 112 (related to the first support surface 102) is lower than that of the second sliding support surface 302 (related to the inner bottom surface of the outer rail 1). The height of the transition table 112 is generally one-half of the height of the second sliding support surface 302. This arrangement can solve the problem that when the height of the second sliding support surface 302 is high, the pulleys of the rail trolley of curtain 4 move on second sliding support surface 302 are unstable. For example, it can solve the problem that when the height of the second sliding support surface 302 is higher than the pulley radius of the rail trolley of curtain 4, the operation of the rail trolley of curtain 4 may be hindered. Therefore, the transition table 112 can make the pulleys of the rail trolley of curtain 4 move on the second sliding support surface 302 more stable and run more smoothly.

In a further embodiment, the rail trolley of curtain is fixed at the lower end of the conveyor belt, the rail trolley of curtain extends out of the outer rail and the inner rail, the rail trolley of curtain can move along the axial direction of the outer rail and the inner rail driven by the conveyor belt, and the rail trolley of curtain can be rotatably installed with the plurality of second pulleys, the second pulleys can slidable upward from the transition table to the second sliding support surface or downward from the second sliding support surface to the transition table.

As shown in FIG. 7 to FIG. 22, in an illustrated embodiment, an upper part of the guide sleeve 101 is provided with first guide rails 104 and second guide rails 105, the first guide rails 104 and the second guide rails 105 are respectively disposed on the first support surface 102 and the second support surface 103 and extend along the axial direction of the guide sleeve 101, the first guide rails 104 are connected to the second guide rails 105, connections of the first guide rails 104 and the second guide rails 105 are provided with steps, the first guide rails 104 are matched with a top of the inner rail 2 to fix both sides of the inner rail 2 relative to the guide sleeve 101.

The second guide rails 105 are matched with a top of the outer rail 1 to fix both sides of the outer rail 1 relative to the guide sleeve 101. The first guide rail 104 and the second guide rail 105 are located above the first support surface 102 and the second support surface 103 respectively and extend along the axial direction of the guide sleeve 101, which can be understood as that the first guide rail 104 and the second guide rail 105 are located in the guide sleeve 101 and away from the corresponding top parts of the first support surface 102 and the second support surface 103. When in use, the shape of the first guide rail 104 is matched with the top end of the inner rail 2, the shape of the second guide rail 105 is matched with the top end of the outer rail 1, and the steps can abut against the connecting end of the outer rail 1, so that the guide sleeve 101 can limit both sides of the inner rail 2, both sides and the connecting end of the outer rail 1.

As shown in FIG. 7 to FIG. 22, in an illustrated embodiment, an outer surface of the bottom of the guide sleeve 101 is provided with a transition surface 111, the transition surface 111 is disposed on a back of the first support surface 102, one end of the transition surface 111 close to the connection between the first support surface 102 and the second support surface 103 is matched with the outer rail 1, the other end of the transition surface 111 is matched with the inner rail 2, and a height difference between the one end of the transition surface 111 matched with the outer rail 1 and the other end of the transition surface 111 is matched with a height difference between the inner rail 1 and the outer rail 2.

A thickness of the bottom surface of the guide sleeve 101 gradually becomes thinner from the connection between the first support surface 102 and the second support surface 103 to the first end of the guide sleeve 101, the outer surface of the bottom of the guide sleeve 101 is provided with the transition surface 111, the transition surface 111 is disposed on the back of the first support surface 102 and on the both sides of the through groove 108. When the bottom surface of the guide sleeve 101 is placed on a horizontal plane, the transition surface 111 is arranged obliquely relative to the horizontal plane, and a height of the transition surface 111 close to the connection between the first support surface 102 and the second support surface 103 is higher than a height of the transition surface 111 close to the first end of the guide sleeve 101. The one end of the transition surface 111 close to the connection between the first support surface 102 and the second support surface 103 is matched with the outer rail 1, the other end of the transition surface 111 is matched with the inner rail 2, and the height difference between the one end of the transition surface 111 matched with the outer rail 1 and the other end of the transition surface 111 is matched with the height difference between the inner rail 1 and the outer rail 2. It can be understood that the other end of the transition surface 111 touches the outer surface of the bottom of the inner rail 2, but it can slide relatively or be slightly spaced. The setting of the transition surface 111 enables the outer pulley 406 of the rail trolley of curtain 4 to transition smoothly among the guide sleeve 101, the inner rail 2 and the outer rail 1 when the curtain guide rail is used with the rail trolley of curtain 4. When the bottom surface of the guide sleeve is placed on the horizontal plane, the transition surface is inclined relative to the horizontal plane, and the height of the transition surface close to the connection of the first support surface and the second support surface is higher than the height of the transition surface close to the first end of the guide sleeve.

As shown in FIG. 7 through FIG. 22, in an embodiment, the guide sleeve 101 further includes a first mating surface 106 and a second mating surface 107, the first mating surface 106 extends inward along the axial direction of the guide sleeve 101 from both sides and a top surface of the first end of the guide sleeve 101 and together with the first support surface 102 form an annular surface with an opening at a bottom thereof, the second mating surface 107 extends inward along the axial direction of the guide sleeve 101 from two side surfaces and a top surface of the second end of the guide sleeve 101 and together with the second support surface 103 form an annular surface with an opening at a bottom thereof. Compared with the second mating surface 107, the first mating surface 106 is closer to a central axis of the guide sleeve 101, in the axial direction of the guide sleeve 101, the first mating surface 106 is connected with the second mating surface 107, and a step is formed at a connection between the first mating surface 106 and the second mating surface 107.

Specifically, an annular surface surrounded by the first mating surface 106 and the first support surface 102 is located in an annular surface surrounded by the second mating surface 107 and the second support surface 103. The distance between the two annular surfaces corresponds to the height difference between the inner guide rail 2 and the outer rail 1 of the curtain guide rail, so that one end of the inner guide rail 2 can smoothly pass through the guide sleeve 101 and be inserted into the outer rail 1, so as to ensure that the curtain guide rail components such as the rail trolley of curtain 4 can make a smooth transition between the interior of the inner rail 2, the interior of the outer rail 1 and the interior of the guide sleeve 101. Compared with the second mating surface 107, the first mating surface 106 is closer to the central axis of the guide sleeve 101, which can be understood as two coaxial semi-annular surfaces spaced internally and externally; the two side surfaces and top surfaces of the first end and the two side surfaces and top surfaces of the second end are directed to the two sides and the top surface inside the guide sleeve 101.

As shown in FIG. 7 to FIG. 22, in an embodiment, the curtain guide rail fixed device 100 further includes a fixed component 113, the fixed component 113 passes through an outer housing of the guide sleeve 101 from outside of the guide sleeve 101 and partially extends into the guide sleeve 101, the fixed component is connected with the inner rail and/or the outer rail to fix the inner rail and/or the outer rail relative to the guide sleeve.

In an embodiment, the fixed component 113 can pass through the housing of the guide sleeve 101 from the top surface, bottom surface and two sides of the guide sleeve 101, and partially extend into the guide sleeve 101. The preferred solution is to pass through the housing of the guide sleeve 101 from the top surface of the guide sleeve 101.

In an embodiment, the fixed component 113 includes a spiral connection fixing, a clamping fixing, a snap spring fixing, a spring fixing and a clamping fixing structure, etc. Specifically, the fixed component 113 is a bolt fixed component. The bolt fixed component includes a fixed bolt 114, a fixed bolt hole 115 and a T-shaped nut 116. The upper part of the T-shaped nut 116 is smaller than the lower part. A limit part 117 with an opening at one hollow end is arranged in the guide sleeve 101, and the opening faces into the guide sleeve 101, the upper part of the T-shaped nut 116 can be nested in the limit part 117, and the fixed bolt 114 passes through the limit part and is connected with the T-shaped nut 116 through the fixed bolt hole 115; when the fixed bolt 114 and the T-shaped nut 116 rotate and fit in the fixed bolt hole 115, the limit part 117 limits the upper part of the T-shaped nut 116, and the T-shaped nut 116 can move outside the guide sleeve 101. The T-shaped nut 116 can better fix the inner rail 2 and the guide sleeve 101.

Referring to FIGS. 7-22, in an embodiment, the curtain guide rail fixed device 100 further includes a fixed component 113, which passes through the housing of the guide sleeve 101 from the outside of the guide sleeve 101 and partially extends into the guide sleeve 101. The fixed component 113 is connected with the inner rail 2 and/or the outer rail 1 to fix the inner rail 2 and/or the outer rail 1 relative to the guide sleeve 101. The preferred solution is to pass through the housing of the guide sleeve 101 from the top surface of the guide sleeve 101. In an embodiment, the fixed component 113 includes a helical connection fixing, a clamping fixing, a snap spring fixing, a spring fixing and a clamping fixing structure, etc.

Referring to FIGS. 7-22, in an embodiment, the fixed component 113 is a fixed bolt 114, the guide sleeve 101 is also provided with a fixed bolt hole matched with the fixed bolt 114, the fixed bolt hole passes through the guide sleeve 101, and the fixed bolt 114 can extend into the guide sleeve 101 through the fixed bolt hole to fix the inner guide rail 2.

Referring to FIGS. 7-22, in an embodiment, the fixed component 113 includes a fixed bolt 114 and a fixed plate, the fixed plate is disposed in the guide sleeve 101, and both the guide sleeve 101 and the fixed plate are provided with fixed bolt holes matched with the fixed bolt 114, under the rotating cooperation of the fixed bolt 114 and the fixed bolt holes, the fixed plate moves inward to press and fix the inner rail 2 or moves outward to clamp and fix the inner rail 2 between the fixed plate and the guide sleeve 101. In an embodiment, the fixed component 113 is a bolt fixed component, the bolt fixed component includes a fixed bolt 114, a fixed bolt hole 115 and a T-shaped nut 116. The upper part of the T-shaped nut 116 is smaller than the lower part. A limit part 117 with an opening on one hollow end is arranged in the guide sleeve 101, the opening faces into the guide sleeve 101, and the upper part of the T-shaped nut 116 can be nested in the limit part 117, the fixed bolt 114 penetrates the limit part and is connected with the T-shaped nut 116 through the fixed bolt hole 115. When the fixed bolt 114 and the T-shaped nut 116 rotate and fit in the fixed bolt hole 115, the limit part 117 limits the upper part of the T-shaped nut 116, and the T-shaped nut 116 can move outside the guide sleeve 101. The T-shaped nut 116 can better fix the inner rail 2 and the guide sleeve 101.

As shown in FIG. 23 to FIG. 32, in an embodiment, the telescopic curtain guide rail further includes an adjusting component fixedly connected with the first fixed pulley 33 and/or the second fixed pulley 34, the adjusting component is configured to cooperate with the first fixed pulley 33 and/or the second fixed pulley 34 to drive the first fixed pulley 33 and/or the second fixed pulley 34 to move, thereby to tension or loosen the conveyor belt, the adjusting of length of the conveyor belt is realized. Avoiding that the length of the conveyor belt is too long and the conveyor belt will run out. It can also avoid that the conveyor belt is too short and affect the smoothness of operation.

The telescopic curtain guide rail provided by the disclosure realizes the movement of the fixed pulley through the adjusting component, thus realizing the adjustment of the length of the conveyor belt 35, realizing the change of the tension of the conveyor belt 35, and overcoming the problem that it is difficult to accurately control the length of the conveyor belt 35 during the assembly of the curtain guide rail. After the curtain guide rail is assembled, the fine adjustment of the length of the conveyor belt 35 can be realized through the adjustment of the adjusting component.

As shown in FIG. 23 to FIG. 32, in an embodiment, the adjusting component includes an adjusting nut 311 and an adjusting screw 312 matched with the adjusting nut 311, and a cooperation of the adjusting screw 312 and the adjusting nut 311 drives the first fixed pulley 33 and/or the second fixed pulley 34 to move, so as to control the tension of the conveyor belt. In this embodiment, one of the first fixed pulley 33 or the second fixed pulley 34 can be adjusted separately through the adjusting component, or the first fixed pulley 33 and the second fixed pulley 34 can be adjusted simultaneously through the adjusting component.

As shown in FIG. 23 to FIG. 32, in an embodiment, the adjusting component further includes a stopper 51, upper and lower ends of the adjusting nut 311 extend towards the stopper 51 and are connected with the stopper 51, the first fixed pulley and/or the second fixed pulley are disposed in an installation area. In an embodiment, the adjusting component adjusts the tightness of the conveyor belt 35 by adjusting the movement of the first fixed pulley 33. In this embodiment, the first fixed pulley 33 is fixed on the adjusting component, specifically, the first fixed pulley 33 is installed and fixed in the installation area formed between the stopper 51 and the adjusting nut 311, the side of the stopper 51 close to the first fixed pulley is an arc surface, and the conveyor belt 35 on two sides of the first fixed pulley 33 are respectively located on two sides of the stopper 51. In this embodiment, by setting the stopper 51, it can better fix the first fixed pulley 33 and realize that the adjusting component can drive the first fixed pulley 33 to move. The side of the stopper 51 close to the adjusting nut 311 is an arc surface, which can avoid the friction damage of the stopper 51 to the conveyor belt 35.

Referring to FIGS. 23-32, in an embodiment, the telescopic curtain guide rail includes the guide sleeve 101, which is a hollow tubular structure with openings at both ends, the bottom surface of the guide sleeve 101 is formed with the first support surface 102 and the second support surface 103, the first support surface 102 is higher than the second support surface 103, and a step 1023 is formed at the connection between the first support surface 102 and the second support surface 103, the guide sleeve 101 is sleeved at one end of the outer rail 1 close to the inner rail 2, the inner rail 2 is connected with the first support surface 102, the outer rail is connected with the second support surface 103, the end of the outer rail 1 abuts against the step 1023, the adjusting component is located in the guide sleeve 101, and the adjusting component is slidably connected with the guide sleeve 101. In this embodiment, the inner rail 2 and the outer rail 1 are connected through the guide sleeve 101 to realize the smooth transition between the inner rail 2 and the outer rail 1, so as to ensure that the curtain can be pulled smoothly during normal use. The setting of the guide sleeve 101 can not only transition the connection between the inner rail 2 and the outer rail 1, making the guide rail more beautiful, but also realize the relative movement of the adjusting component, so as to drive the movement of the first fixed pulley 33 and realize the control of the tension of the conveyor belt.

Referring to FIGS. 23-32, the guide sleeve 101 is provided with an adjusting installation groove 1011, the adjusting installation groove 1011 is arranged in the space surrounded by the first support surface 102, the adjusting component is fixed in the adjusting installation groove 1011, one end of the adjusting installation groove 1011 is provided with an opening, the other end of the adjusting installation groove 1011 is provided with a baffle 1012, the opening is arranged at one end close to the second support surface 103, and the baffle 1012 is provided with a through hole 1013 that can insert the screw. The setting of the baffle 1012 can better limit the adjusting component to the adjusting installation groove 1011. The setting of the opening enables the conveyor belt 35 to extend into the adjusting installation groove 1011 and connect with the first fixed pulley, and the conveyor belt 35 on the other side of the first fixed pulley can also extend out from the adjusting installation groove 1011. The adjusting screw is matched with the adjusting nut through the through hole. When the adjusting screw to rotate, it can drive the adjusting component away from or close to the baffle. The belt tension is adjusted by adjusting the distance between the adjusting component and the baffle 1012.

Referring to FIGS. 23-32, in an embodiment, the top wall of the adjusting installation groove is provided with the first opening 1014, and the bottom wall of the adjusting installation groove is provided with the second opening 1015 opposite to the first opening 1014, and the first fixed pulley and/or the second fixed pulley are fixed in the installing area of the adjusting component through the fixed shaft 3331, and the two ends of the fixed shaft 3331 are respectively extended into the first opening 1014 and the second opening 1015.

Referring to FIGS. 23-32, in an embodiment, the outer rail 1 includes an upper-end first closed groove 12 and a lower-end first opening groove 13, the side wall of the lower-end first opening groove 13 is provided with a first outer rail inner wall 14 and a second outer rail inner wall 15 extending inwardly towards the groove, and a first insertion gap 131 is formed between the bottom wall of the upper-end first closed groove 12 and the first outer rail inner wall 14, a second insertion gap 132 is formed between the bottom wall of the lower-end first opening groove 13 and the second outer rail inner wall 15, and the conveyor belt 35 is located between the first outer rail inner wall 14 and the second outer rail inner wall 15; the inner rail 2 includes an upper-end second closed groove and a lower-end second opening groove. the bottom wall of the upper-end second closed groove is inserted into the first insertion gap 131, and the bottom wall of the lower-end second open groove is inserted into the second insertion gap 132. This mode can realize better nesting of the inner rail 2 and the outer rail 1, better cooperation between the inner rail 2 and the outer rail 1, and better stability of curtain guide rail.

Referring to FIGS. 23-32, in an embodiment, the end of the first outer rail inner wall 14 abuts against the top wall of the adjusting installation groove 1011, and the end of the second outer rail inner wall 15 abuts against the bottom wall of the adjusting installation groove 1011. There is a third insertion gap 133 between the bottom wall of the adjusting installation groove 1011 and the first support surface 102, and the bottom wall of the lower-end second opening groove passes through the third insertion gap 133 and is inserted into the second insertion gap 132. In this embodiment, the adjusting component is fixed by the adjusting installation groove 1011 to achieve a more stable effect. At the same time, the top wall and bottom wall of the adjusting installation groove can match with the first outer rail inner wall 14 and the second outer rail inner wall 15, so that the end of the outer rail 1 can better match with the inner rail 2 in the guide sleeve 101.

Referring to FIGS. 23-32, in an embodiment, when the inner rail 2 is matched with the outer rail 1, the first side wall 26 of the inner rail 2 divides the lower-end first opening groove into the first cavity and the second cavity, the second fixed pulley 34 is fixed on the inner rail 2 through the second fixed component, the second fixed component is provided with a connecting clamp 27, and the connecting clamp 27 clamps the end of the first side wall 26. The portions of the conveyor belt 35 located on two sides of the second fixed pulley 34 are located in the first cavity and the second cavity respectively. In this embodiment, the second fixed pulley 34 is fixed by the connecting clamp 27. After the connecting clamp 27 clamps the end of the first side wall 26, it can be further locked by screws to further ensure the stability of the curtain guide rail.

Referring to FIGS. 23-32, the conveyor belt 35 includes a first connecting section 351 and a second connecting section 352 connected each other. The first connecting section 351 and the second connecting section 352 are connected in a head-to-tail manner. The first connecting section 351 is matched with the driving wheel 31, the second connecting section 352 is wound on the first fixed pulley 33 and the second fixed pulley 34, and the second connecting section 352 is also matched with the driven wheel. In an embodiment, the second connecting section 352 is matched with the driven wheel. In this embodiment, the belt thickness of the first connecting section 351 is greater than that of the second connecting section 352. The belt thickness referred to in this embodiment is not limited to the thickness of the belt, so it can also refer to the diameter of the steel wire or rope.

For example, when the first connecting section 351 and/or the second connecting section 352 are flat drive belt (E. G., a belt, a flat rope), the belt thickness refers to the direct thickness of the belt or flat rope, and when the first connecting section 351 and/or the second connecting section 352 are steel wire or rope with a circular section, the belt thickness refers to the diameter of the steel wire or rope.

In this embodiment, the belt thickness of the first connecting section 351 is greater than that of the second connecting section 352, so that the first connecting section 351 matched with the driving wheel 31 is thicker, which can better drive and avoid wear. The belt thickness of the second connecting section 352 wound on the first fixed pulley 33 and the second fixed pulley 34 is thinner, which can save the space of the guide rail and realize more lightweight and beautiful guide rail.

In an embodiment, the first connecting section 351 is one or more selected from the group consisting of a belt, a steel wire and a rope; and the second connecting section 352 is one or more selected from the group consisting of a belt, a steel wire and a rope.

For those skilled in the art, various other corresponding changes and modifications can be made according to the technical scheme and concept described above, and all these changes and modifications should fall within the protection scope of the appended claims of the disclosure.

What is claimed is:

1. A telescopic curtain guide rail, comprising: an inner rail, an outer rail, a guide sleeve and a transmission unit;

wherein the inner rail is connected to a side of the outer rail, and the inner rail is embedded in the outer rail and slidable along the outer rail; and wherein the transmission unit comprises a driving wheel, a driven wheel, a first fixed pulley and a second fixed pulley, and a conveyor belt, the driving wheel and the driven wheel are respectively located at two opposite ends of the telescopic curtain guide rail, the driving wheel is connected with a motor, the driving wheel is located at an end of the inner rail or the outer rail, the driving wheel and the first fixed pulley are fixed at both ends of one of the inner rail and the outer rail, and the driven wheel and the second fixed pulley are fixed at both ends of the other of the outer rail and the inner rail; the conveyor belt is wound on the driving wheel, the driven wheel, the second fixed pulley and the first fixed pulley sequentially in that order and then returns back to the driving wheel;

wherein sections of the conveyor belt between the driving wheel, the driven wheel, the second fixed pulley and the first fixed pulley are all parallel to allow a rail trolley of the telescopic curtain guide rail to be movable along an axial direction of the outer rail and the inner rail driven by the conveyor belt;

wherein when the inner rail moves towards the outer rail, a distance between the driven wheel and the driving wheel decreases, while a distance between the first fixed pulley and the second fixed pulley increases, conversely, when the inner rail moves away from the outer rail, the distance between the driven wheel and the driving wheel increases, while the distance between the first fixed pulley and the second fixed pulley decreases; and when the motor drives the driving wheel to rotate, the driving wheel drives the conveyor belt;

the guide sleeve is a hollow tubular structure with openings at both ends, and the guide sleeve is sleeved outside a connection between the outer rail and the inner rail;

wherein the outer rail comprises an upper-end first closed groove and a lower-end first opening groove, the inner rail comprises an upper-end second closed groove and a lower-end second opening groove, the upper-end first closed groove is embedded in the upper-end second closed groove;

wherein the inner rail further comprises a first partition plate, the first partition plate is located in the lower-end second opening groove, an upper end of the first partition plate is fixedly connected to an outer side of a bottom of the upper-end second closed groove, segments of the conveyor belt located on two sides of the driven wheel are respectively disposed on two sides of the first partition plate, and groove bottoms of the upper-end first closed groove and the upper-end second closed groove respectively are disposed with protrusions matched with each other;

wherein one side wall of the lower-end second opening groove is in contact with one side wall of the lower-end first opening groove, another side wall of the lower-end second opening groove and another side wall of the lower-end first opening groove together form a fixed pulley receiving chamber, a bottom of the fixed pulley receiving chamber comprises a bottom surface of the outer rail and a bottom surface of the inner rail, and the bottom surface of the inner rail is located above the bottom surface of the outer rail and coincides with the bottom surface of the outer rail;

wherein portions of the conveyor belt located on two sides of the second fixed pulley are respectively disposed on two sides of the side wall of the lower-end second opening groove close to the fixed pulley receiving chamber; and wherein the outer rail comprises an L-shaped partition plate, the L-shaped partition plate is located in the fixed pulley receiving chamber and fixedly connected to an inner wall of the lower-end first opening groove, and portions of the conveyor belt located on two sides of the first fixed pulley are respectively located on two sides of the L-shaped partition plate.

2. The telescopic curtain guide rail according to claim 1, wherein the first fixed pulley and the second fixed pulley are located on same sides of the inner rail and the outer rail.

3. The telescopic curtain guide rail according to claim 1, wherein an opening of each of the lower-end first opening groove and the lower-end second opening groove comprises right-angle bends, the right-angle bends of the lower-end first opening groove are matched with the right-angle bends of the lower-end second opening groove, and upper surfaces of the right-angle bends of the lower-end first opening groove and upper surfaces of the right-angle bends of the lower-end second opening groove are located at a same horizontal plane.

4. The telescopic curtain guide rail according to claim 1, wherein the telescopic curtain guide rail further comprises the rail trolley fixed at a lower end of the conveyor belt, the rail trolley extends out from the outer rail and the inner rail, the rail trolley is movable along an axial direction of the outer rail and the inner rail driven by the conveyor belt, and the rail trolley comprises a trolley body and a plurality of pulleys.

5. The telescopic curtain guide rail according to claim 4, wherein the plurality of pulleys comprise a plurality of first pulleys and a plurality of second pulleys, the plurality of first pulleys and the plurality of second pulleys are rotatably connected to the trolley body, the trolley body comprises an upper main body and a lower main body connected to the upper main body, both sides of the upper main body are provided with the plurality of first pulleys and the plurality of second pulleys, bottoms of the plurality of first pulleys form a first sliding surface, bottoms of the plurality of second pulleys form a second sliding surface, and the second sliding surface is higher than the first sliding surface.

6. The telescopic curtain guide rail according to claim 5, wherein the inner rail is provided with a first sliding support surface, the outer rail is provided with a second sliding support surface;

wherein one of the first pulley and the second pulley is supported on the first sliding support surface when the rail trolley of curtain slides in the inner rail, or the other one of the first pulley and the second pulley is supported on the second sliding support surface when the rail trolley of curtain slides in the outer rail; and a height difference between the second sliding surface and the first sliding surface is matched with a height difference between the first sliding support surface and the second sliding support surface; and wherein each of the plurality of first pulleys and corresponding one of the plurality of second pulleys have different rotation axes; and the rotation axes of the first pulley and the corresponding second pulley are parallel and have a same height, and a radius of the first pulley is greater than that of the corresponding second pulley; and/or, the first pulley and the corresponding second pulley are arranged in a staggered manner in an axial direction of the first pulley and the second pulley, and correspondingly the first sliding support surface and the second sliding support surface are arranged in a staggered manner in the axial direction of the first pulley and the second pulley.

7. The telescopic curtain guide rail according to claim 5, wherein the rail trolley further comprises a plurality of first guide wheels, the plurality of first guide wheels are rotatably connected to the upper main body, the plurality of first guide wheels transversely penetrate through the upper main body, wheel edges of the plurality of first guide wheels protrude outward relative to sides of the upper main body in a transverse direction, the plurality of first guide wheels are rotatable in the transverse direction, and the plurality of first guide wheels are higher than the second sliding surface;

wherein the rail trolley further comprises a plurality of second guide wheels, the plurality of second guide wheels are installed on a top of the upper main body and rotatable in the transverse direction, wheel edges of the plurality of second guide wheels protrude outward relative to the sides of the upper main body in the transverse direction, the plurality of second guide wheels are higher than the plurality of first guide wheels, and a radius of each of the plurality of second guide wheels is different from that of each of the plurality of first guide wheels;

wherein the inner rail is provided with a first guide groove therein, the outer rail is provided with a second guide groove therein; one of the first guide wheel and the second guide wheel is located in the first guide groove and matched with the first guide groove when the rail trolley slides in the inner rail, or the other one of the first guide wheel and the second guide wheel is located in the second guide groove and matched with the second guide groove when the rail trolley slides in the outer rail;

wherein a width of the first guide groove is different from a width of the second guide groove, and a width difference between the first guide groove and the second guide groove is matched with a diameter difference between the first guide wheel and the second guide wheel; and wherein the plurality of first pulleys have a same size and are symmetrically arranged on two sides of the trolley body, and the plurality of second pulleys have a same size and are symmetrically arranged on the two sides of the trolley body;

wherein the rail trolley further comprises a plurality of outer pulleys arranged on the two sides of the trolley body in pairs, and the plurality of outer pulleys are located below the first sliding surface and is spaced a predetermined height from the first sliding surface.

8. The telescopic curtain guide rail according to claim 4, wherein the trolley body is provided with threading through holes, and the conveyor belt comprises a first conveyor belt and a second conveyor belt, the first conveyor belt is connected to the second conveyor belt and sleeved on the driving wheel and the driven wheel to make the driving wheel in transmission connection with the driven wheel, the second conveyor belt is engaged with the driving wheel or the driven wheel, the first conveyor belt is a rope, the first conveyor belt passes through the threading through holes to make the rail trolley be connected to the first conveyor belt and move on the outer rail and/or the inner rail driven by the first conveyor belt.

9. The telescopic curtain guide rail according to claim 8, wherein the trolley body comprises an upper main body and a lower main body connected with the upper main body, the plurality of pulleys are rotatably installed on the upper main body; and wherein the threading through holes comprise first threading through holes and second threading through holes, the upper main body is provided with the first threading through holes, the lower main body is provided with the second threading through holes, the first conveyor belt sequentially passes through the first threading through holes and the second threading through holes to fix the rail trolley, the upper main body of the rail trolley is slidable in the outer rail and/or the inner rail, the lower main body of the rail trolley of curtain is located outside the outer rail and the inner rail, and portions of the first conveyor belt are distributed on two sides of the trolley body of the rail trolley of curtain.

10. The telescopic curtain guide rail according to claim 9, wherein the first conveyor belt comprises a first rope section and a second rope section, the first rope section and the second rope section are separated from each other, a first end of the first rope section is connected with a first end of the second conveyor belt, a second end of the first rope section passes through one of the first threading through holes and one of the second threading through holes and is fixed on the rail trolley, a first end of the second rope section is connected with a second end of the second conveyor belt, and a second end of the second rope section passes through the other one of the first threading through holes and the other one of the second threading through holes and is fixed on the rail trolley;

wherein the rail trolley further comprises a threading fixed device, the threading fixed device is disposed on a side of the lower main body close to the second threading through holes or disposed in the second threading through holes, and the threading fixed device fixes the second end of the first rope section and the second end of the second rope section onto the rail trolley;

wherein each of the second threading through holes is a threading bolt hole arranged on the lower main body in a vertical direction, each of the second threading through holes comprises a second through hole upper opening and a second through hole lower opening, and the second through hole lower opening is disposed on a bottom of the lower main body; the threading fixed device comprises threading bolts and threading nuts, the threading bolts are matched with the second threading through holes respectively, and the threading nuts are matched with the second through hole upper openings of the second threading through holes; the second end of the first rope section and the second end of the second rope section are fixed on the rail trolley by cooperation of the threading bolts and the threading nuts;

wherein the trolley body of the rail trolley is further provided with third threading through holes, the third threading through holes transversely penetrate through the trolley body of the rail trolley, and the first conveyor belt passes through the first threading through holes, the third threading through holes and the second threading through holes sequentially in that order;

wherein each of the first threading through holes comprises a first end opening and a second end opening connected with the first end opening, the first end opening is disposed on one side of the upper main body, and the second end opening is disposed on the other side of the upper main body; the first end opening disposed on the one side of the upper main body is higher than ones of the plurality of pulleys disposed on the one side of the upper main body and outward protruding parts of the ones of the plurality of pulleys disposed on the one side of the upper main body, and the second end opening disposed on the other side of the upper main body is lower than the others of the plurality of pulleys disposed on the other side of the upper main body and outward protruding parts of the others of the plurality of pulleys disposed on the other side of the upper main body; and wherein each of the first threading through holes is an arc through hole transversely penetrating through the trolley body, and the first end opening and the second end opening are disposed on the two sides of the trolley body in a staggered manner.

11. The telescopic curtain guide rail according to claim 1, wherein a connecting end of the outer rail is inserted into the guide sleeve from a second end of the guide sleeve and matched with the guide sleeve, a free end of the outer rail extends out from the guide sleeve, the inner rail is inserted into the guide sleeve from a first end of the guide sleeve and matched with the guide sleeve, a connecting end of the inner rail is inserted into the outer rail, a free end of the inner rail extends out from the guide sleeve, and a rail trolley is fixed at a lower end of the conveyor belt, and the rail trolley is capable of passing through the guide sleeve when moves between the outer rail and the inner rail.

12. The telescopic curtain guide rail according to claim 11, wherein a bottom surface of the guide sleeve is provided with a first support surface and a second support surface, the first support surface extends inward along an axial direction of the guide sleeve from the first end of the guide sleeve, the second support surface extends inward along the axial direction of the guide sleeve from the second end of the guide sleeve, the first support surface is connected to the second support surface, the first support surface is higher than the second support surface, and a step is formed at a connection between the first support surface and the second support surface, the first support surface supports the inner rail, the second support surface supports the outer rail, the outer rail abuts against the step, a height difference of bottom surfaces of the outer rail and the inner rail is matched to a height difference between the second support surface and the first support surface.

13. The telescopic curtain guide rail according to claim 12, wherein the bottom surface of the guide sleeve is provided with a through groove penetrating the first support surface and the second support surface, a bottom of the inner rail is provided with a first sliding opening along the axial direction, a bottom of the outer rail is provided with a second sliding opening along the axial direction, the first sliding opening is communicated with the second sliding opening, and both ends of the through groove are respectively communicated with the first sliding opening and the second sliding opening;

wherein the through groove comprises a first through section and a second through section, the first through section is communicated with the second through section, positions of the first through section and the second through section correspond to positions of the first support surface and the second support surface respectively, a width of the first through section close to the first end of the guide sleeve is greater than a width of the first sliding opening, a width of the first through section close to the second through section is matched with the width of the first sliding opening, and a width of the second through section is matched with a width of the second sliding opening;

wherein the guide sleeve further comprises transition tables, the transition tables are disposed on the both sides of the through groove and protrude upward relative to the first support surface, the transition tables are extended outward along the axial direction of the guide sleeve from the connection between the first support surface and the second support surface, an inner surface of the bottom of the outer rail is provided with a second sliding support surface, the second sliding support surface is axially extended from the connecting end of the outer rail towards the other end of the outer rail, the second sliding support surface is higher than the inner surface of the bottom of the outer rail; when the outer rail is matched with the guide sleeve, the transition tables are butted and matched with the second sliding support surface in the axial direction of the guide sleeve, and the second sliding support surface is higher than the transition tables;

wherein the rail trolley extends out of the outer rail and the inner rail, the rail trolley is movable along the axial direction of the outer rail and the inner rail driven by the conveyor belt, the rail trolley is rotatably installed with a plurality of second pulleys, and the plurality of second pulleys are slidable upward from the transition tables to the second sliding support surface or downward from the second sliding support surface to the transition tables;

wherein an upper part of the guide sleeve is provided with first guide rails and second guide rails, the first guide rails and the second guide rails are respectively disposed on the first support surface and the second support surface and extend along the axial direction of the guide sleeve, the first guide rails are connected to the second guide rails, connections of the first guide rails and the second guide rails are provided with second steps, the first guide rails are matched with a top of the inner rail to fix both sides of the inner rail relative to the guide sleeve, and the second guide rails are matched with a top of the outer rail to fix both sides of the outer rail relative to the guide sleeve;

wherein a thickness of the bottom of the guide sleeve gradually becomes thinner from the connection between the first support surface and the second support surface to the first end of the guide sleeve, an outer surface of the bottom of the guide sleeve is provided with a transition surface, the transition surface is disposed on a back of the first support surface and on the both sides of the through groove, one end of the transition surface close to the connection between the first support surface and the second support surface is matched with the outer rail, the other end of the transition surface is matched with the inner rail, and a height difference between the one end of the transition surface matched with the outer rail and the other end of the transition surface is matched with a height difference between the inner rail and the outer rail; and when the bottom of the guide sleeve is placed on a horizontal plane, the transition surface is arranged obliquely relative to the horizontal plane, and a height of the transition surface close to the connection between the first support surface and the second support surface is higher than a height of the transition surface close to the first end of the guide sleeve;

and/or, the guide sleeve further comprises a first mating surface and a second mating surface, the first mating surface extends inward along the axial direction of the guide sleeve from both side surfaces and a top surface of the first end of the guide sleeve and together with the first support surface form an annular surface with an opening at a bottom thereof, the second mating surface extends inward along the axial direction of the guide sleeve from two side surfaces and a top surface of the second end of the guide sleeve and together with the second support surface form an annular surface with an opening at a bottom thereof; compared with the second mating surface, the first mating surface is closer to a central axis of the guide sleeve; in the axial direction of the guide sleeve, the first mating surface is connected with the second mating surface, and a third step is formed at a connection between the first mating surface and the second mating surface;

wherein the telescopic curtain guide rail further comprises a fixed component;

wherein the fixed component passes through an outer housing of the guide sleeve from outside the guide sleeve and partially extends into the guide sleeve, and the fixed component is connected with the inner rail and/or the outer rail to fix the inner rail and/or the outer rail relative to the guide sleeve; or, the fixed component comprises a fixed bolt and a fixed plate, the fixed plate is disposed in the guide sleeve, the guide sleeve and the fixed plate are provided with fixed bolt holes matching with the fixed bolt, and the fixed plate moves inward to press and fix the inner rail or moves outward to clamp and fix the inner rail between the fixed plate and the guide sleeve under rotating cooperation of the fixed bolt and the fixed bolt holes.

14. The telescopic curtain guide rail according to claim 1, wherein the telescopic curtain guide rail further comprises an adjusting component fixedly connected with the first fixed pulley and/or the second fixed pulley, the adjusting component is configured to cooperate with the first fixed pulley and/or the second fixed pulley to tighten or loosen the conveyor belt, the guide sleeve is provided with an adjusting installation groove therein, and the adjusting installation groove is disposed in a space surrounded by the first support surface.

15. The telescopic curtain guide rail according to claim 14, wherein the adjusting component comprises an adjusting nut and an adjusting screw matched with the adjusting nut, and a cooperation of the adjusting screw and the adjusting nut drives the first fixed pulley and/or the second fixed pulley to move; the adjusting component further comprises a stopper, upper and lower ends of the adjusting nut extend towards the stopper and are connected with the stopper, an installation area is formed between the stopper and the adjusting nut, the first fixed pulley and/or the second fixed pulley is/are fixed in the installation area, a side of the stopper close to the adjusting nut is an arc surface, portions of the conveyor belt located on two sides of the first fixed pulley and/or the second fixed pulley in the installation area are respectively located on two sides of the stopper; one end of the adjusting installation groove is provided with an opening, the other end of the adjusting installation groove is provided with a baffle, the opening is disposed close to the second support surface, the adjusting component is fixed in the adjusting installation groove, the baffle is provided with a through hole, the adjusting screw passes through the through hole to match with the adjusting nut, and the adjusting screw drives the adjusting component to move away from or close to the baffle when being rotated;

a top wall of the adjusting installation groove is provided with a first opening, a bottom wall of the adjusting installation groove is provided with a second opening opposite to the first opening, the first fixed pulley and/or the second fixed pulley are fixed on the adjusting component through a fixed shaft, and two ends of the fixed shaft extend into the first opening and the second opening respectively;

the adjusting installation groove is disposed in the space surrounded by the first support surface, the adjusting component is fixed in the adjusting installation groove and slidably connected with the adjusting installation groove, the first fixed pulley is fixed on the adjusting component, and an end of a first outer rail inner wall of the outer rail abuts against the top wall of the adjusting installation groove, an end of a second outer rail inner wall of the outer rail abuts against the bottom wall of the adjusting installation groove, there is a third insertion gap between the bottom wall of the adjusting installation groove and the first support surface, and a bottom wall of a lower-end second opening groove of the inner rail passes through the third insertion gap and then is inserted into a second insertion gap;

and/or, wherein the outer rail comprises an upper-end first closed groove and a lower-end first opening groove, a side wall of the lower-end first opening groove is provided with a first outer rail inner wall and a second outer rail inner wall extending inwardly towards the lower-end first opening groove, there is a first insertion gap between a bottom wall of the upper-end first closed groove and the first outer rail inner wall, there is a second insertion gap between a bottom wall of the lower-end first opening groove and the second outer rail inner wall, the conveyor belt is located between the first outer rail inner wall and the second outer rail inner wall; the inner rail comprises an upper-end second closed groove and a lower-end second opening groove, a bottom wall of the upper-end second closed groove is inserted into the first insertion gap, and a bottom wall of the upper-end second opening groove is inserted into the second insertion gap; and in the case that the outer rail comprises the lower-end first opening groove and the inner rail comprises the lower-end second opening groove, when the inner rail is engaged with the outer rail, a first side wall of the inner rail divides the lower-end first opening groove into a first cavity and a second cavity, the second fixed pulley is fixed on the inner rail through a second fixed component, the second fixed component is provided with a connecting clamp, the connecting clamp clamps an end of the first side wall, and portions of the conveyor belt located on two sides of the second fixed pulley are located in the first cavity and the second cavity respectively.

16. The telescopic curtain guide rail according to claim 1, wherein the conveyor belt comprises a first connecting section and a second connecting section, the first connecting section and the second connecting section are connected in a head-to-tail manner, the first connecting section is matched with the driving wheel, the second connecting section is wound on the first fixed pulley and the second fixed pulley, and a belt thickness of the first connecting section is greater than a belt thickness of the second connecting section; and wherein the first connecting section is one or more selected from the group consisting of a belt, a steel wire and a rope; and the second connecting section is one or more selected from the group consisting of a belt, a steel wire and a rope.

17. A telescopic curtain guide rail, comprising: an inner rail, an outer rail, a guide sleeve and a transmission unit;

wherein the inner rail is connected to a side of the outer rail, and the inner rail is embedded in the outer rail and slidable along the outer rail;

wherein the transmission unit comprises a driving wheel, a driven wheel, a first fixed pulley and a second fixed pulley, and a conveyor belt, the driving wheel and the driven wheel are respectively located at two opposite ends of the telescopic curtain guide rail, the driving wheel is connected with a motor, the driving wheel is located at an end of the inner rail or the outer rail, the driving wheel and the first fixed pulley are fixed at both ends of one of the inner rail and the outer rail, and the driven wheel and the second fixed pulley are fixed at both ends of the other of the outer rail and the inner rail; the conveyor belt is wound on the driving wheel, the driven wheel, the second fixed pulley and the first fixed pulley sequentially in that order and then returns back to the driving wheel;

wherein sections of the conveyor belt between the driving wheel, the driven wheel, the second fixed pulley and the first fixed pulley are all parallel to allow a rail trolley of the telescopic curtain guide rail to be movable along an axial direction of the outer rail and the inner rail driven by the conveyor belt;

wherein when the inner rail moves towards the outer rail, a distance between the driven wheel and the driving wheel decreases, while a distance between the first fixed pulley and the second fixed pulley increases;

conversely, when the inner rail moves away from the outer rail, the distance between the driven wheel and the driving wheel is increased increases, while the distance between the first fixed pulley and the second fixed pulley decreases; and when the motor drives the driving wheel to rotate, the driving wheel drives the conveyor belt;

wherein the guide sleeve is a hollow tubular structure with openings at both ends, and the guide sleeve is sleeved outside a connection between the outer rail and the inner rail;

wherein the outer rail comprises an upper-end first closed groove and a lower-end first opening groove, the inner rail comprises an upper-end second closed groove and a lower-end second opening groove, the upper-end first closed groove is embedded in the upper-end second closed groove, the lower-end second opening groove is embedded in the lower-end first opening groove, and a horizontal cross-sectional area of the lower-end second opening groove is less than that of the lower-end first opening groove;

wherein the inner rail further comprises a first partition plate, the first partition plate is located in the lower-end second opening groove, an upper end of the first partition plate is fixedly connected to an outer side of a bottom of the upper-end second closed groove, segments of the conveyor belt located on two sides of the driven wheel are respectively disposed on two sides of the first partition plate, and groove bottoms of the upper-end first closed groove and the upper-end second closed groove respectively are disposed with protrusions matched with each other;

wherein one side wall of the lower-end second opening groove is in contact with one side wall of the lower-end first opening groove, another side wall of the lower-end second opening groove and another side wall of the lower-end first opening groove together form a fixed pulley receiving chamber, a bottom of the fixed pulley receiving chamber comprises a bottom surface of the outer rail and a bottom surface of the inner rail, and the bottom surface of the inner rail is located above the bottom surface of the outer rail and coincides with the bottom surface of the outer rail;

wherein portions of the conveyor belt located on two sides of the second fixed pulley are respectively disposed on two sides of the side wall of the lower-end second opening groove close to the fixed pulley receiving chamber; and wherein the outer rail comprises an L-shaped partition plate, the L-shaped partition plate is located in the fixed pulley receiving chamber and fixedly connected to an inner wall of the lower-end first opening groove, and portions of the conveyor belt located on two sides of the first fixed pulley are respectively located on two sides of the L-shaped partition plate.

* * * * *